US009494363B2

(12) United States Patent
Yamashita

(10) Patent No.: US 9,494,363 B2
(45) Date of Patent: Nov. 15, 2016

(54) AIR-CONDITIONING APPARATUS

(75) Inventor: Koji Yamashita, Tokyo (JP)

(73) Assignee: MITSUBISHI ELELCTRIC CORPORATION, Tokyo (JP)

( * ) Notice: Subject to any disclaimer, the term of this patent is extended or adjusted under 35 U.S.C. 154(b) by 566 days.

(21) Appl. No.: 13/822,365

(22) PCT Filed: Oct. 12, 2010

(86) PCT No.: PCT/JP2010/006046

§ 371 (c)(1),
(2), (4) Date: Mar. 12, 2013

(87) PCT Pub. No.: WO2012/049702

PCT Pub. Date: Apr. 19, 2012

(65) Prior Publication Data

US 2013/0167572 A1 Jul. 4, 2013

(51) Int. Cl.

| | |
|---|---|
| ***F25D 29/00*** | (2006.01) |
| ***F25B 13/00*** | (2006.01) |
| ***F25B 25/00*** | (2006.01) |
| ***F25B 47/00*** | (2006.01) |
| *F25B 9/00* | (2006.01) |

(52) U.S. Cl.

CPC ..... *F25D 29/00* (2013.01); *F25B 13/00* (2013.01); *F25B 25/005* (2013.01); *F25B 47/006* (2013.01); *F25B 9/006* (2013.01); *F25B 2313/02732* (2013.01); *F25B 2313/02741* (2013.01)

(58) Field of Classification Search

CPC .... F25B 47/02; F25B 47/025; F25B 47/027; F25B 47/006; F25B 2313/02741

See application file for complete search history.

(56) References Cited

U.S. PATENT DOCUMENTS

| | | | | |
|---|---|---|---|---|
| 4,211,207 | A * | 7/1980 | Molivadas | 126/587 |
| 4,644,756 | A * | 2/1987 | Sugimoto et al. | 62/160 |
| 4,962,648 | A * | 10/1990 | Takizawa et al. | 62/199 |
| 5,320,167 | A * | 6/1994 | Johnson | B60H 1/3202 165/61 |

(Continued)

FOREIGN PATENT DOCUMENTS

| | | |
|---|---|---|
| EP | 0 750 166 A2 | 12/1996 |
| EP | 1 548 377 A2 | 6/2005 |

(Continued)

OTHER PUBLICATIONS

G. Hundy et al., Compressor Performance Definition for Refrigerants with Glide.*

(Continued)

*Primary Examiner* — Frantz Jules
*Assistant Examiner* — Nelson Nieves
(74) *Attorney, Agent, or Firm* — Posz Law Group, PLC

(57) ABSTRACT

An air-conditioning apparatus uses a zeotropic refrigerant mixture, in which its saturated liquid refrigerant temperature is lower than the saturated gas refrigerant temperature under the same pressure condition, as the heat source side refrigerant. When one or some of a plurality of heat exchangers related to heat medium functions as an evaporator, the air-conditioning apparatus executes an anti-freezing control that prevents the heat medium from freezing by estimating occurrence of freezing of the heat medium on the basis of a value obtained by subtracting a freezing temperature correction value that is set as a positive value larger than zero from an evaporating temperature of the refrigerant in the heat exchanger related to heat medium.

15 Claims, 10 Drawing Sheets

(56) References Cited

U.S. PATENT DOCUMENTS

| | | | | |
|---|---|---|---|---|
| 5,490,556 | A * | 2/1996 | Pichotta | B60H 1/00828 165/255 |
| 5,651,263 | A * | 7/1997 | Nonaka et al. | 62/205 |
| 5,737,931 | A * | 4/1998 | Ueno et al. | 62/126 |
| 6,119,478 | A * | 9/2000 | Sada et al. | 62/434 |
| 6,170,270 | B1 * | 1/2001 | Arshansky et al. | 62/81 |
| 6,434,959 | B2 * | 8/2002 | Kobayashi et al. | 62/180 |
| 6,881,354 | B2 * | 4/2005 | Arman et al. | 252/67 |
| 6,964,172 | B2 * | 11/2005 | Dudley | F25D 21/006 62/151 |
| 7,469,546 | B2 * | 12/2008 | Kates | 62/129 |
| 2004/0123608 | A1 * | 7/2004 | Kamimura et al. | 62/114 |
| 2007/0209789 | A1 * | 9/2007 | Oomura et al. | 165/202 |
| 2008/0053141 | A1 * | 3/2008 | Kim | F24F 3/06 62/434 |
| 2010/0107661 | A1 * | 5/2010 | Awwad | B60H 1/321 62/80 |
| 2010/0326129 | A1 * | 12/2010 | Moriwaki et al. | 62/498 |

FOREIGN PATENT DOCUMENTS

| | | | |
|---|---|---|---|
| JP | 05-280818 | A | 10/1993 |
| JP | H06337176 | * | 6/1994 |
| JP | 06-337176 | A | 12/1994 |
| JP | 08-313079 | A | 11/1996 |
| JP | H0914771 | * | 9/1997 |
| JP | 11-304263 | A | 11/1999 |
| JP | 2000-161797 | A | 6/2000 |
| JP | 2001-289465 | A | 10/2001 |
| JP | 2003-343936 | A | 12/2003 |
| JP | 2003343936 | A * | 12/2003 |
| JP | 2004-286407 | A | 10/2004 |
| JP | 2005-140444 | A | 6/2005 |
| JP | 2009-300021 | A | 12/2009 |
| WO | 2010/049998 | A1 | 5/2010 |
| WO | 2010/050003 | A1 | 5/2010 |
| WO | WO 2010109617 | A1 * | 9/2010 |
| WO | 2010-128553 | A1 | 11/2010 |
| WO | WO 2010128553 | A1 * | 11/2010 |

OTHER PUBLICATIONS

Extended European Search Report dated Mar. 28, 2014 issued in corresponding EP patent application No. 10858366.7.

Office Action mailed on Jul. 3, 2014 in corresponding CN application No. 201080069567.4 (with English translation).

Office Action mailed on Sep. 30, 2014 in corresponding JP application No. 22012-538473 (with English translation).

Office Action mailed Mar. 18, 2014 in corresponding JP Application No. 2012-538473 (English Translation).

International Search Report of the International Searching Authority mailed Jan. 18, 2011 for the corresponding international application No. PCT/JP2010/006046 (with English translation).

* cited by examiner

AIR-CONDITIONING APPARATUS

CROSS REFERENCE TO RELATED APPLICATION

This application is a U.S. national stage application of PCT/JP2010/006046 filed on Oct. 12, 2010.

TECHNICAL FIELD

The present invention relates to an air-conditioning apparatus that is applied to, for example, a multi-air-conditioning apparatus for a building.

BACKGROUND

In conventional air-conditioning apparatuses such as a multi-air-conditioning apparatus for a building, a refrigerant is circulated between an outdoor unit, which is a heat source unit disposed, for example, outside a structure, and indoor units disposed in rooms in the structure. A conditioned space is cooled or heated by heated or cooled air, from which a refrigerant has released or absorbed heat. Regarding the refrigerant used for such an air-conditioning apparatus, a hydrofluorocarbon (HFC) refrigerant, for example, is typically used. An air-conditioning apparatus using a natural refrigerant, such as carbon dioxide ($CO_2$), has also been proposed.

Furthermore, in an air-conditioning apparatus called a chiller, cooling energy or heating energy is generated in a heat source unit disposed outside a structure. Water, antifreeze, or the like is heated or cooled by a heat exchanger disposed in an outdoor unit and is carried to an indoor unit, such as a fan coil unit or a panel heater, to perform heating or cooling (see Patent Literature 1, for example).

Moreover, there is an air-conditioning apparatus called an exhaust heat recovery chiller that connects a heat source unit to each indoor unit with four water pipes arranged therebetween, supplies cooled and heated water or the like simultaneously, and allows the cooling and heating in the indoor units to be selected freely (see Patent Literature 2, for example).

In addition, there is an air-conditioning apparatus in which a heat exchanger for a primary refrigerant and a secondary refrigerant is disposed near each indoor unit so that the secondary refrigerant is carried to the indoor unit (see Patent Literature 3, for example).

Furthermore, there is an air-conditioning apparatus that connects an outdoor unit to each branch unit including a heat exchanger with two pipes so that a secondary refrigerant is carried to an indoor unit (see Patent Literature 4, for example).

Additionally, there is an air-conditioning apparatus such as a multi-air-conditioning apparatus for a building that, while circulating a heat medium such as water to indoor units, reduces conveyance power of the heat medium by circulating a refrigerant from an outdoor unit to a relay unit and by circulating the heat medium, such as water, from the relay unit to the indoor units (see Patent Literature 5, for example).

PATENT LITERATURE

Patent Literature 1: Japanese Unexamined Patent Application Publication No. 2005-140444 (p. 4, FIG. 1, for example).

Patent Literature 2: Japanese Unexamined Patent Application Publication No. 5-280818 (pp. 4 and 5, FIG. 1, for example).

Patent Literature 3: Japanese Unexamined Patent Application Publication No. 2001-289465 (pp. 5 to 8, FIGS. 1 and 2, for example).

Patent Literature 4: Japanese Unexamined Patent Application Publication No. 2003-343936 (p. 5, FIG. 1).

Patent Literature 5: WO2010049998 (p. 3, FIG. 1, for example).

In a conventional air-conditioning apparatus such as a multi-air-conditioning apparatus for a building, since the refrigerant is circulated to an indoor unit, there is a possibility of refrigerant leakage in, for example, an indoor space. On the other hand, in the air-conditioning apparatus disclosed in Patent Literature 1 and Patent Literature 2, the refrigerant does not pass through the indoor unit. However, in the air-conditioning apparatus disclosed in Patent Literature 1 and Patent Literature 2, the heat medium needs to be heated or cooled in a heat source unit disposed outside a structure, and needs to be conveyed to the indoor unit side. Accordingly, a circulation path of the heat medium becomes long. In this case, when carrying heat for predetermined heating or cooling work with the heat medium, energy consumption due to conveyance power and the like becomes larger than that of the refrigerant. Accordingly, as the circulation path becomes long, the conveyance power becomes markedly large. This indicates that energy saving can be achieved in an air-conditioning apparatus if the circulation of the heat medium can be controlled appropriately.

In the air-conditioning apparatus disclosed in Patent Literature 2, the four pipes connecting the outdoor side and the indoor space need to be arranged in order to allow cooling or heating to be selectable in each indoor unit. Disadvantageously, there is little ease of construction. In the air-conditioning apparatus disclosed in Patent Literature 3, secondary medium circulating means such as a pump needs to be provided for each indoor unit. Disadvantageously, the system is not only costly but also creates a large noise, and is not practical. In addition, since the heat exchanger is disposed near each indoor unit, risk of refrigerant leakage in a place near the indoor space cannot be eliminated.

In the air-conditioning apparatus disclosed in Patent Literature 4, a primary refrigerant that has exchanged heat flows into the same passage as that of the primary refrigerant before heat exchange. Accordingly, when a plurality of indoor units is connected, each indoor unit cannot demonstrate maximum capacity. Such a configuration wastes energy. Furthermore, each branch unit is connected to an extension pipe with a total of four pipes, two for cooling and two for heating. This configuration is consequently similar to that of the system in which the outdoor unit is connected to each branching unit with four pipes. Accordingly, there is little ease of construction in such a system.

In the air-conditioning apparatus disclosed in Patent Literature 5, no problem arises when a single mixed refrigerant or a near-azeotropic refrigerant is used as the refrigerant; however, when a zeotropic refrigerant mixture is used as the refrigerant, there is a risk of the heat medium such as water becoming frozen due to a temperature gradient between the saturated liquid temperature and the saturated gas temperature of the refrigerant in a case where a refrigerant-heat medium heat exchanger is used as an evaporator.

SUMMARY

The present invention has been provided to overcome the above-described problems, and an object thereof is to provide an air-conditioning apparatus capable of preventing a heat medium from freezing while saving energy. An object of some aspects of the present invention is to provide an air-conditioning apparatus capable of increasing safety by not circulating the refrigerant to or near an indoor unit. Another object of some aspects of the present invention is to provide an air-conditioning apparatus capable of improving ease of construction and increasing energy efficiency by using a refrigerant with low GWP and by reducing the connecting pipes between an outdoor unit and a branch unit (heat medium relay unit) or the connecting pipes between the branch unit and an indoor unit.

Solution to Problem

The air-conditioning apparatus according to the present invention includes a refrigerant circuit that connects, with refrigerant pipes, a compressor, a first refrigerant flow switching device, a heat source side heat exchanger, a plurality of first expansion devices, and refrigerant side passages of a plurality of heat exchangers related to heat medium, the refrigerant circuit circulating a heat source side refrigerant; a heat medium circuit that connects, with heat medium pipes, a pump, a use side heat exchanger, and heat medium side passages of the plurality of heat exchangers related to heat medium, the heat medium circuit circulating a heat medium; and the heat source side refrigerant and the heat medium exchanging heat in the heat exchangers related to heat medium; wherein when a zeotropic refrigerant mixture in which a saturated liquid refrigerant temperature is lower than a saturated gas refrigerant temperature under a same pressure condition is used as the heat source side refrigerant, and when at least one of the heat exchangers related to heat medium is functioning as an evaporator, an anti-freezing temperature is set to estimate an occurrence of freezing of the heat medium on the basis of a value obtained by subtracting a freezing temperature correction value set as a positive value that is larger than zero from an evaporating temperature of the refrigerant in the at least one of the heat exchangers related to heat medium and an anti-freezing control that prevents the heat medium from freezing is executed on a basis of a comparison between a temperature of the refrigerant in the at least one of the heat exchangers related to heat medium and the anti-freezing temperature.

According to the air-conditioning apparatus of the present invention, the pipes in which the heat medium circulates can be shortened and the required conveyance power is reduced, and thus, safety is increased and energy is saved. Further, according to the air-conditioning apparatus of the present invention, even if there is leakage of the heat medium, it will be a small amount. Accordingly, safety is further increased. Furthermore, according to the air-conditioning apparatus of the present invention, freezing of the heat medium can be efficiently prevented, and thus, safety is increased even further.

DETAILED DESCRIPTION

An exemplary embodiment of the present invention will be described below with reference to the drawings.

Figure 1:
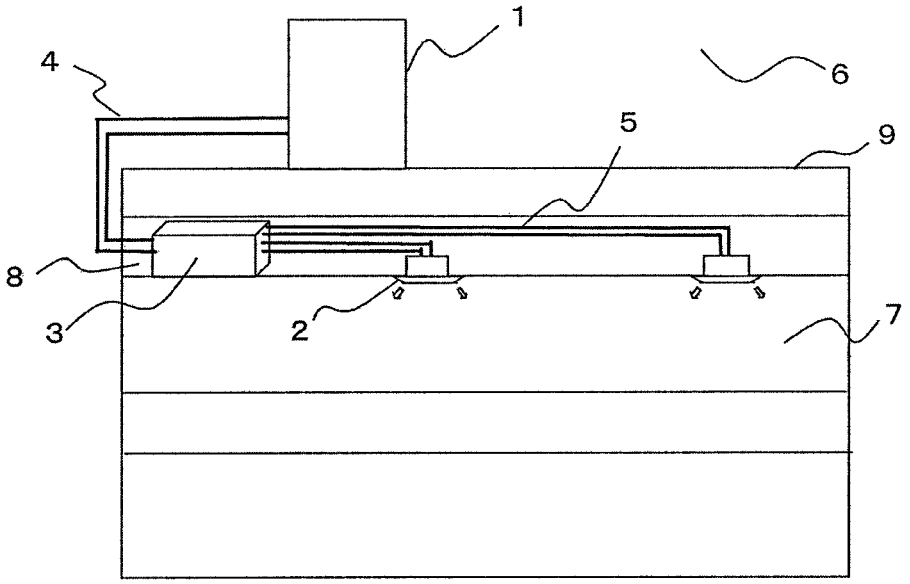
FIG. 1 is a schematic diagram illustrating an exemplary installation of an air-conditioning apparatus according to an exemplary embodiment of the present invention.
Figure 2:
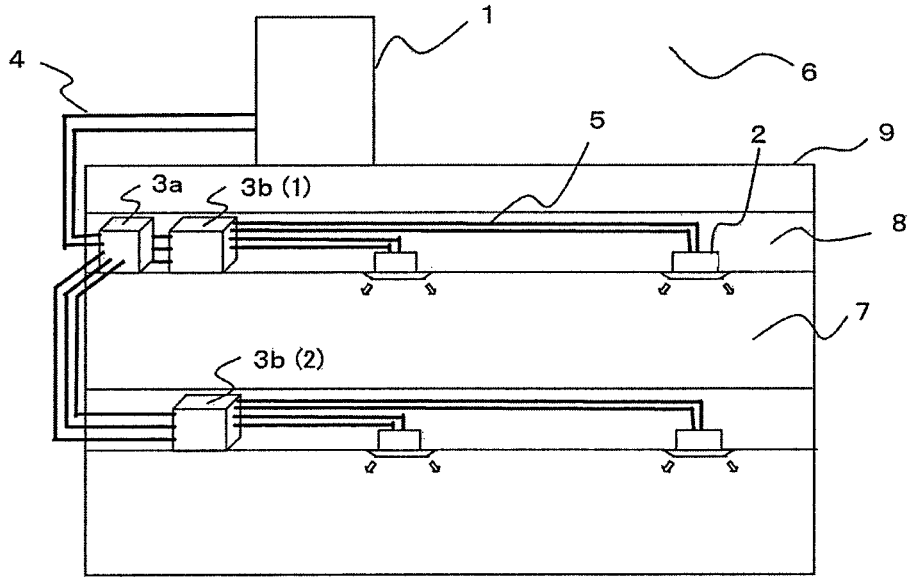
FIG. 2 is a schematic diagram illustrating another exemplary installation of an air-conditioning apparatus according to the exemplary embodiment of the present invention.

FIGS. 1 and 2 are schematic diagrams illustrating exemplary installations of an air-conditioning apparatus according to the exemplary embodiment of the present invention. The exemplary installations of the air-conditioning apparatus will be described with reference to FIGS. 1 and 2. This air-conditioning apparatus uses refrigeration cycles (a refrigerant circuit A and a heat medium circuit B) that circulate refrigerants (a heat source side refrigerant and a heat medium) so that each indoor unit can freely select a cooling mode or a heating mode as an operation mode. It should be noted that the dimensional relationships of components in FIG. 1 and other subsequent drawings may be different from the actual ones.

Referring to FIG. 1, the air-conditioning apparatus according to the exemplary embodiment includes a single outdoor unit 1 functioning as a heat source unit, a plurality of indoor units 2, and a heat medium relay unit 3 disposed between the outdoor unit 1 and the indoor units 2. The heat medium relay unit 3 exchanges heat between the heat source side refrigerant and the heat medium. The outdoor unit 1 and the heat medium relay unit 3 are connected with refrigerant pipes 4 through which the heat source side refrigerant flows. The heat medium relay unit 3 and each indoor unit 2 are connected with pipes (heat medium pipes) 5 through which the heat medium flows. Cooling energy or heating energy generated in the outdoor unit 1 is delivered to the indoor units 2 through the heat medium relay unit 3.

Referring to FIG. 2, the air-conditioning apparatus according to the exemplary embodiment includes the single outdoor unit 1, the plurality of indoor units 2, a plurality of separated heat medium relay units 3 (a main heat medium relay unit 3*a* and sub heat medium relay units 3*b*) disposed between the outdoor unit 1 and the indoor units 2. The outdoor unit 1 and the main heat medium relay unit 3*a* are connected with the refrigerant pipes 4. The main heat medium relay unit 3*a* and the sub heat medium relay units 3*b* are connected with the refrigerant pipes 4. The sub heat medium relay units 3*b* are connected to the indoor units 2 with the pipes 5. Cooling energy or heating energy generated in the outdoor unit 1 is delivered to the indoor units 2 through the main heat medium relay unit 3*a* and the sub heat medium relay units 3*b*.

The outdoor unit 1 is typically disposed in an outdoor space 6, which is a space (e.g., a roof) outside a structure 9, such as a building, and is configured to supply cooling energy or heating energy to the indoor units 2 through the heat medium relay unit 3. Each indoor unit 2 is disposed at a position that can supply cooling air or heating air to an indoor space 7, which is a space (e.g., a living room) inside the structure 9, and supplies the cooling air or heating air to the indoor space 7 that is a conditioned space. The heat medium relay unit 3 is configured with a housing separate from the outdoor unit 1 and the indoor units 2 such that the heat medium relay unit 3 can be disposed at a position different from those of the outdoor space 6 and the indoor space 7, and is connected to the outdoor unit 1 through the refrigerant pipes 4 and is connected to the indoor units 2 through the pipes 5 to convey cooling energy or heating energy supplied from the outdoor unit 1 to the indoor units 2.

As illustrated in FIGS. 1 and 2, in the air-conditioning apparatus according to the exemplary embodiment, the outdoor unit 1 is connected to the heat medium relay unit 3 using two refrigerant pipes 4, and the heat medium relay unit 3 is connected to each indoor unit 2 using two pipes 5. As described above, in the air-conditioning apparatus according to the exemplary embodiment, each of the units (the outdoor unit 1, the indoor units 2, and the heat medium relay unit 3) is connected using two pipes (the refrigerant pipes 4 or the pipes 5), thus construction is facilitated.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) derived from the main heat medium relay unit 3*a*. This separation allows a plurality of sub heat medium relay units 3*b* to be connected to the single main heat medium relay unit 3*a*. In this configuration, the number of refrigerant pipes 4 connecting the main heat medium relay unit 3*a* to each sub heat medium relay unit 3*b* is three. Details of this circuit will be described in detail later (see FIG. 4).

Referring to FIGS. 1 and 2, note that a state is illustrated in which each heat medium relay unit 3 is disposed in the structure 9 but in a space different from the indoor space 7, for example, a space above a ceiling (hereinafter, simply referred to as a "space 8"). The heat medium relay unit 3 can be disposed in other spaces, such as a common space where an elevator or the like is installed. Further, although FIGS. 1 and 2 illustrate a case in which the indoor units 2 are of a ceiling-mounted cassette type, the indoor units are not limited to this type, and, for example, a ceiling-concealed type, a ceiling-suspended type, or any type of indoor unit that can blow out heating air or cooling air into the indoor space 7 directly or through a duct or the like may be used.

While FIGS. 1 and 2 illustrate a case in which the outdoor unit 1 is disposed in the outdoor space 6, the arrangement is not limited to this case. For example, the outdoor unit 1 may be disposed in an enclosed space, for example, a machine room with a ventilation opening, may be disposed inside the structure 9 as long as waste heat can be exhausted through an exhaust duct to the outside of the structure 9, or may be disposed inside the structure 9 when the outdoor unit 1 that is used is of a water-cooled type. Even when the outdoor unit 1 is disposed in such a place, no problem in particular will occur.

Furthermore, the heat medium relay unit 3 can be disposed near the outdoor unit 1. It should be noted that when the distance from the heat medium relay unit 3 to each indoor unit 2 is excessively long, the advantageous effect of energy saving is reduced because power for conveying the heat medium becomes significantly large. Additionally, the numbers of connected outdoor units 1, indoor units 2, and heat medium relay units 3 are not limited to those illustrated in FIGS. 1 and 2. The numbers thereof can be determined in accordance with the structure 9 where the air-conditioning apparatus according to the exemplary embodiment is installed.

Figure 3:
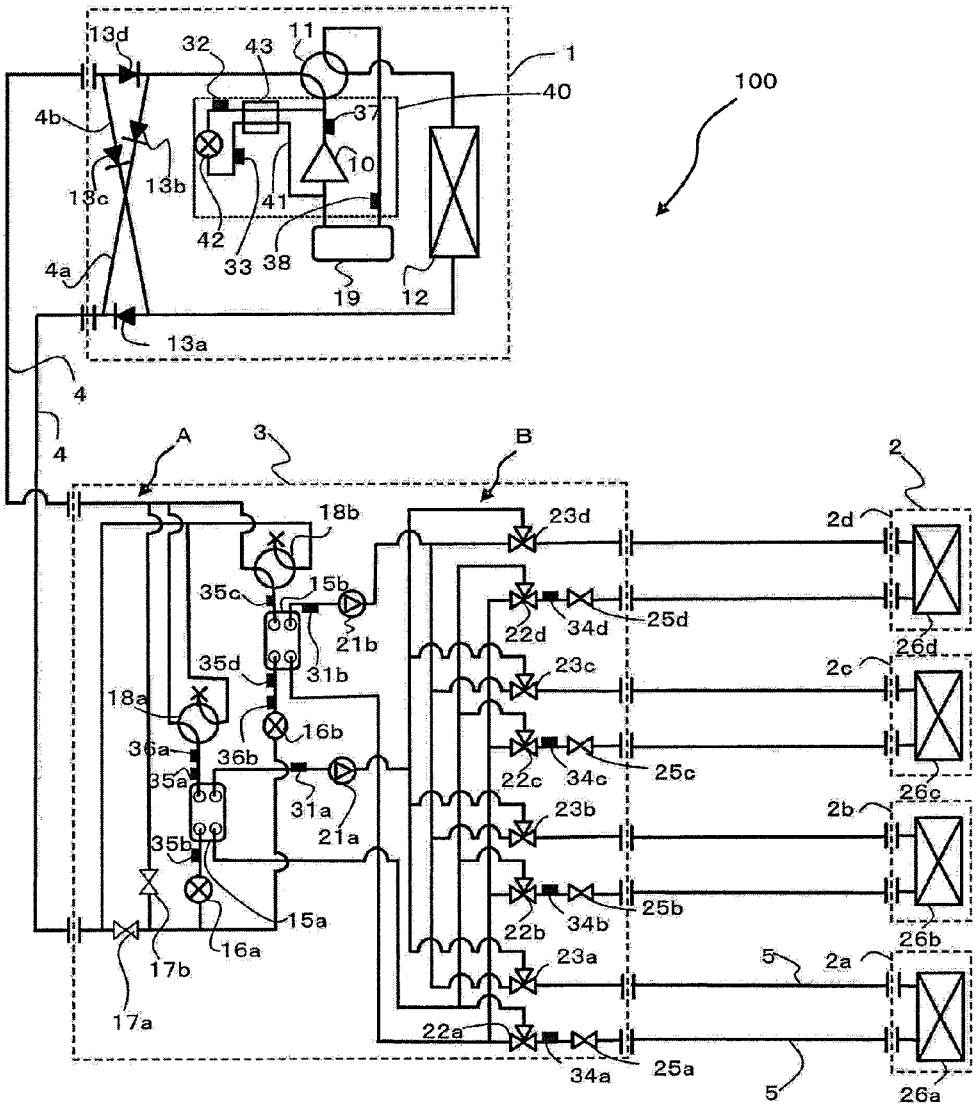
FIG. 3 is a schematic circuit diagram illustrating an exemplary circuit configuration of the air-conditioning apparatus according to the exemplary embodiment of the present invention.

FIG. 3 is a schematic circuit diagram illustrating an exemplary circuit configuration of the air-conditioning apparatus (hereinafter, referred to as an "air-conditioning apparatus 100") according to the exemplary embodiment. The detailed configuration of the air-conditioning apparatus 100 will be described with reference to FIG. 3. As illustrated in FIG. 3, the outdoor unit 1 and the heat medium relay unit 3 are connected with the refrigerant pipes 4 through heat exchangers related to heat medium 15*a* and 15*b* included in the heat medium relay unit 3. Furthermore, the heat medium relay unit 3 and the indoor units 2 are connected with the pipes 5 through the heat exchangers related to heat medium 15*a* and 15*b*. Note that the refrigerant pipe 4 and the pipe 5 will be described in detail later.

[Outdoor Unit 1]

The outdoor unit 1 includes a compressor 10, a first refrigerant flow switching device 11 such as a four-way valve, a heat source side heat exchanger 12, and an accumulator 19, which are connected in series with the refrigerant pipes 4. The outdoor unit 1 is further provided with a first connecting pipe 4*a*, a second connecting pipe 4*b*, a check valve 13*a*, a check valve 13*b*, a check valve 13*c*, and a check valve 13*d*. By providing the first connecting pipe 4*a*, the second connecting pipe 4*b*, the check valve 13*a*, the check valve 13*b*, the check valve 13*c*, and the check valve 13*d*, the heat source side refrigerant can be made to flow into the heat medium relay unit 3 in a constant direction irrespective of the operation requested by the indoor units 2.

Furthermore, the outdoor unit 1 includes a high-low pressure bypass pipe 41 that connects a passage on the discharge side and a passage on the inlet side of the compressor 10, a bypass expansion device (a second expansion device) 42 that is disposed in the high-low pressure bypass pipe, and a refrigerant-to-refrigerant heat exchanger 43 that is disposed in the high-low pressure bypass pipe 41 and that exchanges heat between the high-low pressure bypass pipe 41 before and after the bypass expansion device 42. That is, the discharge side of the compressor 10, a primary side (the discharge refrigerant passage from the compressor 10) of the refrigerant-to-refrigerant heat exchanger 43, the bypass expansion device 42, the secondary side (the suction refrigerant passage to the compressor 10) of the refrigerant-to-refrigerant heat exchanger 43, and the suction side of the compressor 10 are connected with the high-low pressure bypass pipe 41. Note that the high-low pressure bypass pipe 41, the bypass expansion device 42, and the refrigerant-to-refrigerant heat exchanger 43 will be described in detail later.

The outdoor unit 1 further includes a fourth temperature sensor (a high-pressure side refrigerant temperature detection device) 32 disposed on an inlet side of the bypass expansion device 42, a fifth temperature sensor (a low-pressure side refrigerant temperature detection device) 33 disposed on an outlet side of the bypass expansion device 42, a second pressure sensor (a high-pressure side pressure detection device) 37 capable of detecting a high-pressure side pressure of the compressor 10, and a third pressure sensor (a low-pressure side pressure detection device) 38 capable of detecting a low-pressure side pressure of the compressor 10. As for the second pressure sensor 37 and the third pressure sensor 38, a method having a strain gauge type, a solid state type, or the like may be used. As for the fourth temperature sensor 32 and the fifth temperature sensor 33, a method having a thermistor type or the like may be used. Note that the second pressure sensor 37, the third pressure sensor 38, the fourth temperature sensor 32, and the fifth temperature sensor 33 will be described in detail later.

The compressor 10 sucks in the heat source side refrigerant and compresses the heat source side refrigerant to a high-temperature high-pressure state. The compressor 10 may include, for example, a capacity-controllable inverter compressor. The first refrigerant flow switching device 11 switches the flow of the heat source side refrigerant between a heating operation (a heating only operation mode and a heating main operation mode) and a cooling operation (a cooling only operation mode and a cooling main operation mode).

The heat source side heat exchanger 12 functions as an evaporator in the heating operation, functions as a condenser (or a radiator) in the cooling operation, exchanges heat between air supplied from an air-sending device such as a fan (not shown) and the heat source side refrigerant, and evaporates and gasifies or condenses and liquefies the heat source side refrigerant. The accumulator 19 is provided on the suction side of the compressor 10 and retains excessive refrigerant due to a difference in the heating operation and the cooling operation or excessive refrigerant due to a transitional operation change.

The check valve 13*d* is provided in the refrigerant pipe 4 between the heat medium relay unit 3 and the first refrigerant flow switching device 11 and permits the heat source side refrigerant to flow only in a predetermined direction (the direction from the heat medium relay unit 3 to the outdoor unit 1). The check valve 13*a* is provided in the refrigerant pipe 4 between the heat source side heat exchanger 12 and the heat medium relay unit 3 and permits the heat source side refrigerant to flow only in a predetermined direction (the direction from the outdoor unit 1 to the heat medium relay unit 3). The check valve 13*b* is provided in the first connecting pipe 4*a* and allows the heat source side refrigerant discharged from the compressor 10 to flow through the heat medium relay unit 3 during the heating operation. The check valve 13*c* is disposed in the second connecting pipe 4*b* and allows the heat source side refrigerant returning from the heat medium relay unit 3 to flow to the suction side of the compressor 10 during the heating operation.

The first connecting pipe 4*a* connects the refrigerant pipe 4, between the first refrigerant flow switching device 11 and the check valve 13*d*, to the refrigerant pipe 4, between the check valve 13*a* and the heat medium relay unit 3, in the outdoor unit 1. The second connecting pipe 4*b* connects the refrigerant pipe 4, between the check valve 13*d* and the heat medium relay unit 3, to the refrigerant pipe 4, between the heat source side heat exchanger 12 and the check valve 13*a*, in the outdoor unit 1. It should be noted that FIG. 3 illustrates a case in which the first connecting pipe 4*a*, the second connecting pipe 4*b*, the check valve 13*a*, the check valve 13*b*, the check valve 13*c*, and the check valve 13*d* are provided, but the device is not limited to this case, and they do not necessarily have to be provided.

[Indoor Units 2]

The indoor units 2 each include a use side heat exchanger 26. The use side heat exchanger 26 is connected to a heat medium flow control device 25 and a second heat medium flow switching device 23 in the heat medium relay unit 3 with the pipes 5. Each of the use side heat exchangers 26 exchanges heat between air supplied from an air-sending device such as a fan (not shown) and the heat medium in order to generate air for heating or air for cooling to be supplied to the indoor space 7.

FIG. 3 illustrates a case in which four indoor units 2 are connected to the heat medium relay unit 3. Illustrated are, from the bottom of the drawing, an indoor unit 2*a*, an indoor unit 2*b*, an indoor unit 2*c*, and an indoor unit 2*d*. In addition, the use side heat exchangers 26 are illustrated as, from the bottom of the drawing, a use side heat exchanger 26*a*, a use side heat exchanger 26*b*, a use side heat exchanger 26*c*, and a use side heat exchanger 26*d* respectively corresponding to the indoor units 2*a* to 2*d*. As is the case of FIGS. 1 and 2, the number of connected indoor units 2 illustrated in FIG. 3 is not limited to four.

[Heat Medium Relay Unit 3]

The heat medium relay unit 3 includes the two heat exchangers related to heat medium 15, two expansion devices (first expansion devices) 16, two on-off devices 17, two second refrigerant flow switching devices 18, two pumps 21, four first heat medium flow switching devices 22, the four second heat medium flow switching devices 23, and the four heat medium flow control devices 25. An air-conditioning apparatus in which the heat medium relay unit 3 is separated into the main heat medium relay unit 3*a* and the sub heat medium relay unit 3*b* will be described later with reference to FIG. 4.

Each of the two heat exchangers related to heat medium 15 (the heat exchanger related to heat medium 15*a* and the heat exchanger related to heat medium 15*b*) functions as a condenser (radiator) or an evaporator and exchanges heat between the heat source side refrigerant and the heat medium in order to transfer cooling energy or heating energy generated in the outdoor unit 1 and stored in the heat source side refrigerant, to the heat medium. The heat exchanger related to heat medium 15*a* is disposed between an expansion device 16*a* and a second refrigerant flow switching device 18*a* in the refrigerant circuit A and is used to cool the heat medium in a cooling and heating mixed operation mode. Additionally, the heat exchanger related to heat medium 15*b* is disposed between an expansion device 16*b* and a second refrigerant flow switching device 18*b* in the refrigerant circuit A and is used to heat the heat medium in the cooling and heating mixed operation mode.

The two expansion devices 16 (the expansion devices 16*a* and 16*b*) each have functions of a reducing valve and an expansion valve and are configured to reduce the pressure of and expand the heat source side refrigerant. The expansion device 16*a* is disposed upstream of the heat exchanger related to heat medium 15*a* in the heat source side refrigerant flow during the cooling operation. The expansion device 16*b* is disposed upstream of the heat exchanger related to heat medium 15*b* in the heat source side refrigerant flow during the cooling operation. Each of the two expansion devices 16 may include a component having a variably controllable opening degree such as an electronic expansion valve.

The two on-off devices 17 (an on-off device 17*a* and an on-off device 17*b*) each include, for example, a two-way valve, and open and close the refrigerant pipe 4. The on-off device 17*a* is disposed in the refrigerant pipe 4 on the inlet side of the heat source side refrigerant. The on-off device 17*b* is disposed in a pipe connecting the refrigerant pipe 4 on the inlet side of the heat source side refrigerant and the refrigerant pipe 4 on the outlet side thereof.

The two second refrigerant flow switching devices 18 (the second refrigerant flow switching devices 18*a* and 18*b*) each include, for example, a four-way valve and switch the flow of the heat source side refrigerant in accordance with the operation mode. The second refrigerant flow switching device 18*a* is disposed downstream of the heat exchanger related to heat medium 15*a* in the heat source side refrigerant flow during the cooling operation. The second refrigerant flow switching device 18*b* is disposed downstream of the heat exchanger related to heat medium 15*b* in the heat source side refrigerant flow during the cooling only operation mode.

The two pumps 21 (a pump 21*a* and a pump 21*b*) circulate the heat medium flowing through the pipes 5. The pump 21*a* is disposed in the pipe 5 between the heat exchanger related to heat medium 15*a* and the second heat medium flow switching devices 23. The pump 21*b* is disposed in the pipe 5 between the heat exchanger related to heat medium 15*b* and the second heat medium flow switching devices 23. The two pumps 21 each include, for example, a capacity-controllable pump and may be capable of controlling the flow rate according to the load in the indoor units 2.

The four first heat medium flow switching devices 22 (first heat medium flow switching devices 22*a* to 22*d*) each includes, for example, a three-way valve and switches passages of the heat medium. The first heat medium flow switching devices 22 are arranged so that the number thereof (four in this case) corresponds to the installed number of indoor units 2. Each first heat medium flow switching device 22 is disposed on an outlet side of a heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding heat medium flow control device 25. Furthermore, illustrated from the bottom of the drawing are the first heat medium flow switching device 22*a*, the first heat medium flow switching device 22*b*, the first heat medium flow switching device 22*c*, and the first heat medium flow switching device 22*d*, so as to correspond to the respective indoor units 2. Further, regarding the switching of the heat medium passage, not only a complete switching from one to the other but a partial switching from one to the other is also included.

The four second heat medium flow switching devices 23 (second heat medium flow switching devices 23*a* to 23*d*) each include, for example, a three-way valve and are each configured to switch passages of the heat medium. The second heat medium flow switching devices 23 are arranged so that the number thereof (four in this case) corresponds to the installed number of indoor units 2. Each second heat medium flow switching device 23 is disposed on an inlet side of the heat medium passage of the corresponding use side heat exchanger 26 such that one of the three ways is connected to the heat exchanger related to heat medium 15*a*, another one of the three ways is connected to the heat exchanger related to heat medium 15*b*, and the other one of the three ways is connected to the corresponding use side heat exchanger 26. Furthermore, illustrated from the bottom of the drawing are the second heat medium flow switching device 23*a*, the second heat medium flow switching device 23*b*, the second heat medium flow switching device 23*c*, and the second heat medium flow switching device 23*d* so as to correspond to the respective indoor units 2. Further, regarding the switching of the heat medium passage, not only a complete switching from one to the other but a partial switching from one to the other is also included.

The four heat medium flow control devices 25 (heat medium flow control devices 25*a* to 25*d*) each include, for example, a two-way valve capable of controlling the area of opening, and each controls the flow rate of the heat medium flowing in the pipe 5. The heat medium flow control devices 25 are arranged so that the number thereof (four in this case) corresponds to the installed number of indoor units 2. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. That is, each heat medium flow control device 25 controls the amount of heat medium flowing into the corresponding indoor unit 2 by the temperatures of the heat medium flowing in and flowing out of the indoor unit 2, and thus is capable of supplying the optimum amount of heat medium corresponding to the indoor load to the indoor unit 2.

Furthermore, illustrated from the bottom of the drawing are the heat medium flow control device 25*a*, the heat medium flow control device 25*b*, the heat medium flow control device 25*c*, and the heat medium flow control device 25*d* so as to correspond to the respective indoor units 2. In addition, each of the heat medium flow control devices 25 may be disposed on the inlet side of the heat medium passage of the corresponding use side heat exchanger 26. Additionally, each heat medium flow control device 25 may be disposed on the inlet side of the heat medium passage of the corresponding use side heat exchanger 26, that is, between the corresponding second heat medium flow switching device 23 and use side heat exchanger 26. Furthermore, when no load is demanded in the indoor unit 2 such as during suspension or thermostat off, the heat medium flow control device 25 may be totally closed, thus stopping the supply of the heat medium to the indoor unit 2.

The heat medium relay unit 3 includes various detection means (two first temperature sensors 31, four second temperature sensors 34, four third temperature sensors 35, and two first pressure sensors 36). Information (temperature information and pressure information) detected by these detection means is transmitted to a controller (not shown) that performs integrated control of the operation of the air-conditioning apparatus 100 such that the information is used to control, for example, the driving frequency of the compressor 10, the rotation speed of the air-sending device (not shown), switching of the first refrigerant flow switching device 11, the driving frequency of the pumps 21, switching of the second refrigerant flow switching devices 18, switching of the heat medium passage, and heat medium flow rate control of the indoor units 2.

The two first temperature sensors 31 (a first temperature sensor 31*a* and a first temperature sensor 31*b*) detects the temperature of the heat medium flowing out of the corresponding heat exchanger related to heat medium 15, namely, the heat medium at an outlet of the corresponding heat exchanger related to heat medium 15 and may include, for example, a thermistor. The first temperature sensor 31*a* is disposed in the pipe 5 on the inlet side of the pump 21*a*. The first temperature sensor 31*b* is disposed in the pipe 5 on the inlet side of the pump 21*b*.

The four second temperature sensors 34 (second temperature sensor 34*a* to 34*d*) are disposed between the corresponding first heat medium flow switching device 22 and heat medium flow control device 25 and detects the temperature of the heat medium flowing out of the corresponding use side heat exchanger 26. A thermistor or the like may be used as the second temperature sensor 34. The second temperature sensors 34 are arranged so that the number thereof (four in this case) corresponds to the installed number of indoor units 2. Note that illustrated from the bottom of the drawing are the second temperature sensor 34*a*, the second temperature sensor 34*b*, the second temperature sensor 34*c*, and the second temperature sensor 34*d* so as to correspond to the respective indoor units 2. Further, each of the second temperature sensors 34 may be disposed in the passage between the corresponding heat medium flow control device 25 and the use side heat exchanger 26.

The four third temperature sensors 35 (third temperature sensors 35*a* to 35*d*) are disposed on the inlet side or the outlet side of the heat source side refrigerant of the heat exchanger related to heat medium 15 and detects the temperature of the heat source side refrigerant flowing into the heat exchanger related to heat medium 15 or the temperature of the heat source side refrigerant flowing out of the heat exchanger related to heat medium 15 and may include, for example, a thermistor. The third temperature sensor 35*a* is disposed between the heat exchanger related to heat medium 15*a* and the second refrigerant flow switching device 18*a*. The third temperature sensor 35*b* is disposed between the heat exchanger related to heat medium 15*a* and the expansion device 16*a*. The third temperature sensor 35*c* is disposed between the heat exchanger related to heat medium 15*b* and the second refrigerant flow switching device 18*b*. The third temperature sensor 35*d* is disposed between the heat exchanger related to heat medium 15*b* and the expansion device 16*b*.

Similar to the installation position of the third temperature sensor 35*d*, a first pressure sensor 36*b* is disposed between the heat exchanger related to heat medium 15*b* and the expansion device 16*b* and is configured to detect the pressure of the heat source side refrigerant flowing between the heat exchanger related to heat medium 15*b* and the expansion device 16*b*. Similar to the installation position of the third temperature sensor 35*a*, a first pressure sensor 36*a* is disposed between the heat exchanger related to heat medium 15*a* and the second refrigerant flow switching device 18*a* and is configured to detect the pressure of the heat source side refrigerant flowing between the heat exchanger related to heat medium 15*a* and the second refrigerant flow switching device 18*a*.

Further, controllers that are not shown each include, for example, a microcomputer and are provided in the units, that is, the outdoor unit 1 and the heat medium relay unit 3, respectively. On the basis of the information detected by the various detection means and a command from a remote control, the controller connected to the outdoor unit 1 controls, for example, the driving frequency of the compressor 10, the rotation speed (including ON/OFF) of the air-sending device, and switching of the first refrigerant flow switching device 11, and the controller connected to the heat medium relay unit 3 controls the driving of the pumps 21, the opening degree of each expansion device 16, on and off of each on-off device 17, switching of the second refrigerant flow switching devices 18, switching of the first heat medium flow switching devices 22, switching of the second heat medium flow switching devices 23, and the driving of each heat medium flow control device 25, such that various operation modes described later are carried out.

The pipes 5 in which the heat medium flows include the pipes connected to the heat exchanger related to heat medium 15*a* and the pipes connected to the heat exchanger related to heat medium 15*b*. The pipes 5 are branched (into four in this case) in accordance with the number of indoor units 2 connected to the heat medium relay unit 3. The pipes 5 are connected with the first heat medium flow switching devices 22 and the second heat medium flow switching devices 23. Controlling the first heat medium flow switching devices 22 and the second heat medium flow switching devices 23 determines whether the heat medium flowing from the heat exchanger related to heat medium 15*a* is allowed to flow into the use side heat exchanger 26 or whether the heat medium flowing from the heat exchanger related to heat medium 15*b* is allowed to flow into the use side heat exchanger 26.

In the air-conditioning apparatus 100, the compressor 10, the first refrigerant flow switching device 11, the heat source side heat exchanger 12, the on-off devices 17, the second refrigerant flow switching devices 18, refrigerant passages of the heat exchanger related to heat medium 15, the expansion devices 16, and the accumulator 19 are connected through the refrigerant pipe 4, thus forming the refrigerant circuit A. In addition, heat medium passages of the heat exchangers related to heat medium 15, the pumps 21, the first heat medium flow switching devices 22, the heat medium flow control devices 25, the use side heat exchangers 26, and the second heat medium flow switching devices 23 are connected through the pipes 5, thus forming the heat medium circuit B. In other words, the plurality of use side heat exchangers 26 is connected in parallel to each of the heat exchangers related to heat medium 15, thus turning the heat medium circuit B into a multi-system.

Accordingly, in the air-conditioning apparatus 100, the outdoor unit 1 and the heat medium relay unit 3 are connected through the heat exchanger related to heat medium 15*a* and the heat exchanger related to heat medium 15*b* provided in the heat medium relay unit 3. The heat medium relay unit 3 and each indoor unit 2 are connected through the heat exchanger related to heat medium 15*a* and the heat exchanger related to heat medium 15*b*. In other words, in the air-conditioning apparatus 100, the heat exchanger related to heat medium 15*a*, and the heat exchanger related to heat medium 15*b* exchange heat between the heat source side refrigerant circulating in the refrigerant circuit A and the heat medium circulating in the heat medium circuit B.

Figure 4:
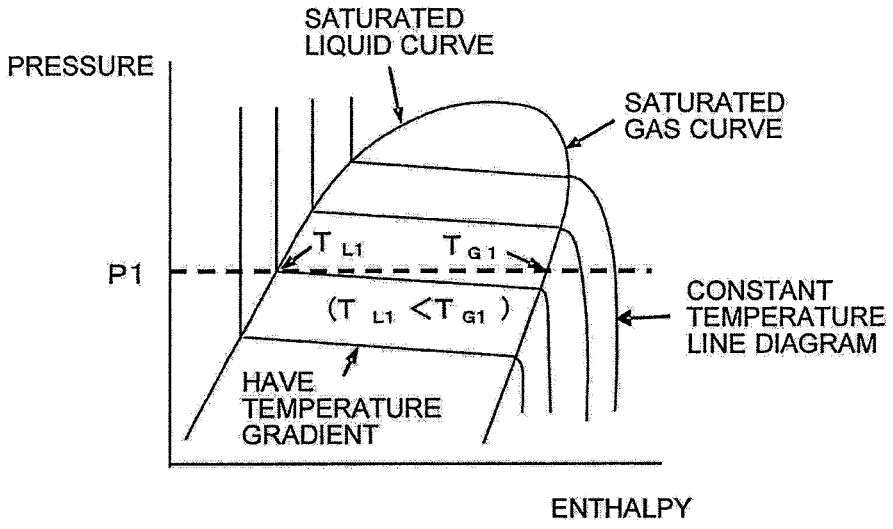
FIG. 4 is a P-h diagram illustrating a state of a heat source side refrigerant of the air-conditioning apparatus according to the exemplary embodiment of the present invention.
Figure 5:
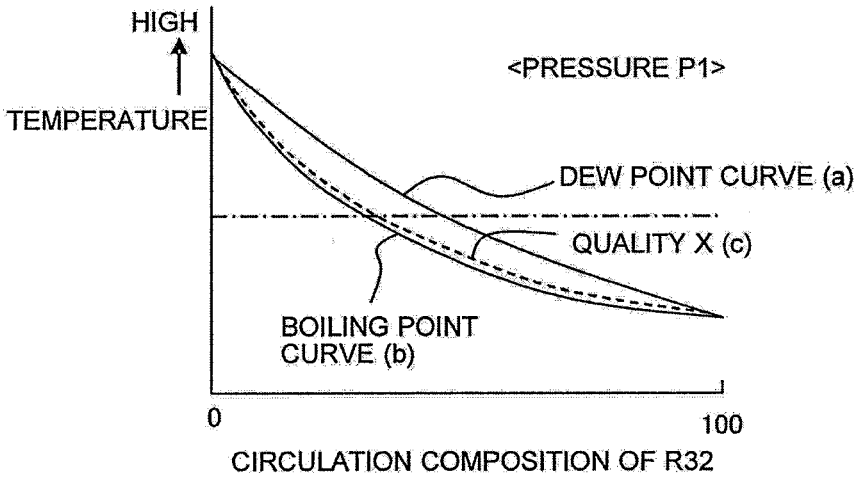
FIG. 5 is a vapor-liquid equilibrium diagram of a mixed refrigerant composed of two types of refrigerants at a pressure P1 illustrated in FIG. 4.
Figure 6:
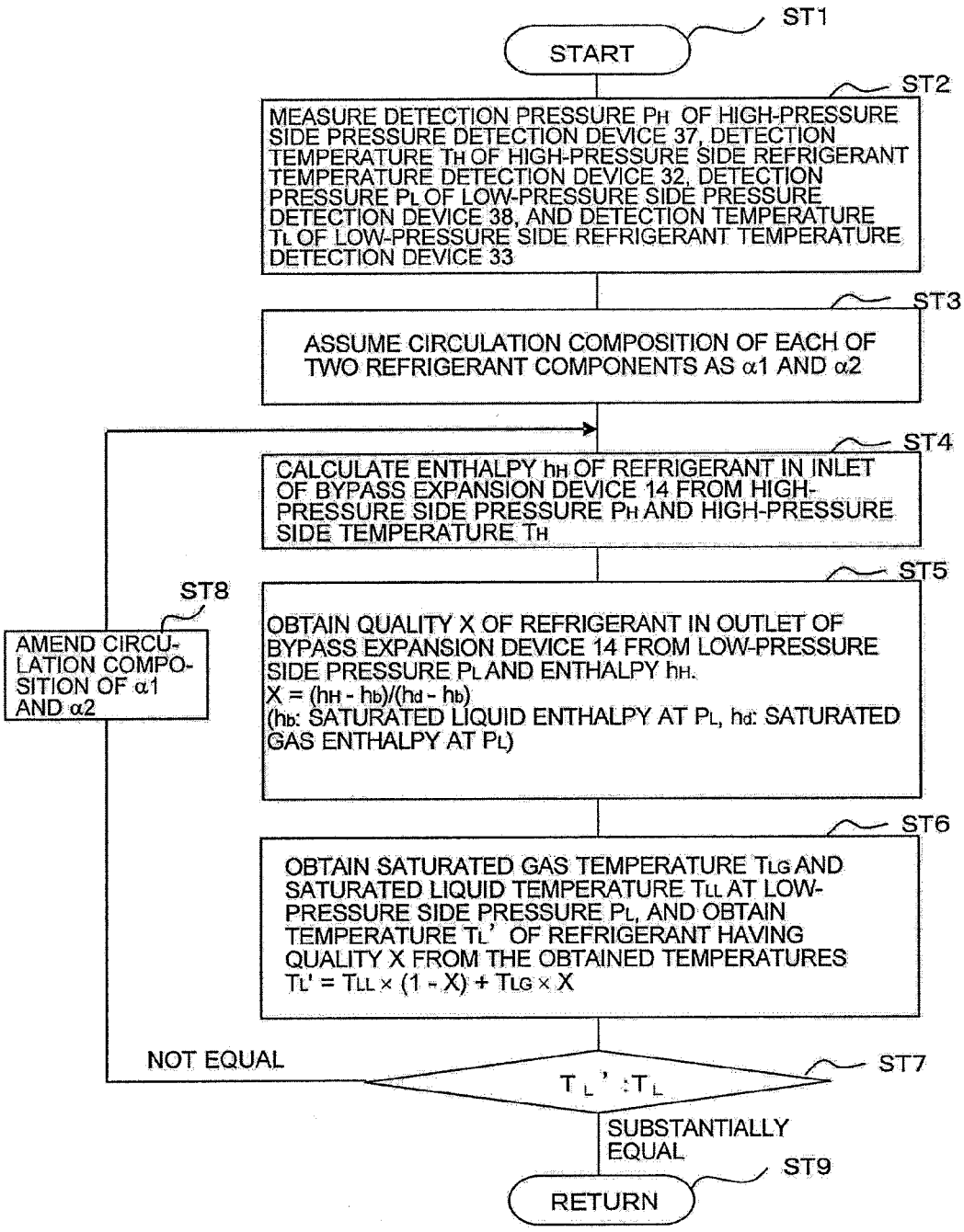
FIG. 6 is a flowchart illustrating a flow of a circulation composition detection process executed by the air-conditioning apparatus according to the exemplary embodiment of the present invention.
Figure 7:
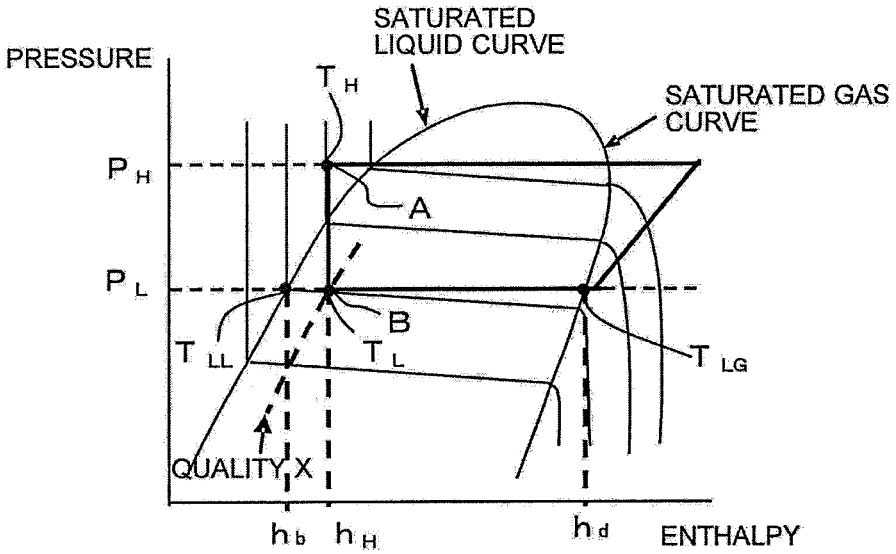
FIG. 7 is a P-h diagram illustrating another state of the heat source side refrigerant of the air-conditioning apparatus according to the exemplary embodiment of the present invention.

The high-low pressure bypass pipe 41, the bypass expansion device 42, the refrigerant-to-refrigerant heat exchanger 43, the second pressure sensor 37, the third pressure sensor 38, the fourth temperature sensor 32, and the fifth temperature sensor 33 will now be described in detail. FIG. 4 is a P-h diagram (pressure (axis of ordinates)-enthalpy (axis of abscissas) diagram) illustrating a state of the heat source side refrigerant of the air-conditioning apparatus 100. FIG. 5 is a vapor-liquid equilibrium diagram of a mixed refrigerant composed of two types of refrigerants at a pressure P1 illustrated in FIG. 4. FIG. 6 is a flowchart illustrating a flow of a circulation composition detection process executed by the air-conditioning apparatus 100. FIG. 7 is a P-h diagram illustrating another state of the heat source side refrigerant of the air-conditioning apparatus 100.

First, description will be given of the heat source side refrigerant that is filled in the refrigerant pipes 4 and that circulates in the refrigerant circuit A. The air-conditioning apparatus 100 uses a mixed refrigerant including, for example, tetrafluoropropene (HFO-1234y or HFO-1234ze) expressed by the chemical formula $C_3H_2F_4$ and difluoromethane (R32) expressed by the chemical formula $CH_2F_2$ as the heat source side refrigerant circulated in the refrigerant circuit A.

Tetrafluoropropene contains a double bond in its chemical formula and has properties such as being easily decomposed in the atmosphere and having a global warming potential (GWP) that is low (GWP of 4 to 6, for example). Accordingly, tetrafluoropropene is environmentally friendly. However, since tetrafluoropropene has density that is lower than that of conventional refrigerants such as R410A, when used alone as the refrigerant, a substantially large compressor is disadvantageously required in order to exhibit a high heating capacity or a high cooling capacity. Further, in order to prevent increase in pressure loss in the refrigerant pipe, the refrigerant pipe needs to be disadvantageously large. In other words, the air-conditioning apparatus becomes costly.

On the other hand, R32 has a property close to that of conventional refrigerants (R410A, for example) and is a refrigerant that is relatively easy to use. However, although the GWP of R32 is 675 which is low compared with the GWP 2088 of R410A, using R32 alone lacks environmental consideration.

Accordingly, the air-conditioning apparatus 100 uses a mixture of tetrafluoropropene (HFO-1234yf or HFO-1234ze) and R32. As such, the refrigerant properties can be improved without largely increasing the GWP and, thus, an efficient air-conditioning apparatus that is friendly to the global environment can be obtained. Regarding the mixture ratio, a mixture of, for example, 70 percent by mass of tetrafluoropropene and 30 percent by mass of R32 may be used; however, the mixture ratio is not limited to this in particular. Further, refrigerants other than tetrafluoropropene and R32 may be included.

Note that the boiling point of HFO-1234yf is −29° C. and that of R32 is −53.2° C., and accordingly the refrigerant is a zeotropic refrigerant that has different boiling points. As such, owing to the existence of a liquid receiver such as the accumulator 19 or the like, the composition ratio (hereinafter, referred to as "circulation composition") of the refrigerant that is circulating in the refrigerant circuit A changes momentarily. Since zeotropic refrigerants have different boiling points, the saturated liquid temperature and the saturated gas temperature at the same pressure is different, as shown in FIG. 4 when plotted on a P-h diagram. That is, as shown in FIG. 4, when tetrafluoropropene is mixed with R32, a saturated liquid temperature $T_{L1}$ and a saturated gas temperature $T_{G1}$ are not equal at a pressure P1, and $T_{G1}$ is higher in temperature than $T_{L1}$. Accordingly, the constant temperature line is inclined in the two-phase region of the P-h diagram.

Further, when the ratio of the mixed refrigerants is changed, the P-h diagram will be different and the temperature gradient will change. For example, when the mixture ratio of HFO-1234yf and R32 is 70% and 30%, respectively, the temperature gradient is substantially large such that the temperature gradient on the high-pressure side is about 5.5° C. and that on the low-pressure side is about 7° C.; and when the mixture ratio is 50% and 50%, the temperature gradient is not particularly large such that the temperature gradient on the high-pressure side is about 2.3° C. and that on the low-pressure side is about 2.8° C. That is, if not provided with a function of detecting the circulation composition of the refrigerant, it will not be possible to obtain the saturated liquid temperature and the saturated gas temperature at the operation pressure of the refrigeration cycle (the refrigerant circuit A).

A circulation composition detection of the heat source side refrigerant executed by the air-conditioning apparatus 100 will now be described. The air-conditioning apparatus 100 includes, in the outdoor unit 1, a circulation composition detection means 40 that can measure the circulation composition of the refrigerant in the refrigeration cycle. This circulation composition detection means 40 includes the high-low pressure bypass pipe 41, the bypass expansion device 42, the refrigerant-to-refrigerant heat exchanger 43, the fourth temperature sensor 32, the fifth temperature sensor 33, the second pressure sensor 37, and the third pressure sensor 38. That is, the circulation composition detection means 40 includes a circuit connecting the discharge side and the suction side of the compressor 10 with the high-low pressure bypass pipe 41, the fourth temperature sensor 32 and the fifth temperature sensor 33 that each detect the temperature at a predetermined position of the circuit, and the second pressure sensor 37 and the third pressure sensor 38 that each detect the pressure at a predetermined position of the circuit.

The circulation composition detection of the heat source side refrigerant executed by the air-conditioning apparatus 100 will be described specifically with reference to FIGS. 5 to 7. Note that a case will be discussed in which a mixture of two types of refrigerant (HFO-1234yf and R32) is used as the heat source side refrigerant. In FIG. 5, the two solid lines indicate a dew point curve (line (a)) that is a saturated gas line when the gas refrigerant is condensed and liquefied and a boiling point curve (line (b)) that is a saturated liquid line when the liquid refrigerant is evaporated and gasified. Further, the single dashed line indicates quality X (line (c)). Note that in FIG. 5, the axis of ordinates represents the temperature and the axis of abscissas represents the circulation composition ratio of R32.

In the air-conditioning apparatus 100, when the controller starts processing, the circulation composition detection of the heat source side refrigerant is executed (ST1). First, a high-pressure side pressure $P_H$ detected by the second pressure sensor 37, the high-pressure side temperature $T_H$ detected by the fourth temperature sensor 32, the low-pressure side pressure $P_L$ detected by the third pressure sensor 38, and the low-pressure side temperature $T_L$ detected by the fifth temperature sensor 33 are input to the controller (ST2). Next, the controller assumes that the circulation composition of the two refrigerant components that are circulating in the refrigeration cycle is $\alpha$1 and $\alpha$2 (ST3).

If the components of the refrigerant are determined, the enthalpy of the refrigerant can be calculated from the pressure and temperature of the refrigerant. As such, the controller obtains the enthalpy $h_H$ of the refrigerant on the inlet side of the bypass expansion device 42 from the high-pressure side pressure $P_H$ and the high-pressure side temperature $T_H$ (ST4, point A indicated in FIG. 7). Then, since there is no change in enthalpy of the refrigerant when the refrigerant is expanded by the bypass expansion device 42, the controller obtains the quality X of the two-phase refrigerant on the outlet side of the bypass expansion device 42 from the low-pressure side pressure $P_L$ and the enthalpy $h_H$ with the following Equation (1) (ST5, point B indicated in FIG. 7).

$$X=(h_H-h_b)/(h_d-h_b), \quad \text{Equation (1)}$$

where $h_b$ is the saturated liquid enthalpy at the low-pressure side pressure $P_L$, and $h_d$ is the saturated gas enthalpy at the low-pressure side pressure $P_L$.

Further, the controller can obtain the temperature $T_L'$ of the refrigerant having the quality X from the saturated gas temperature $T_{LG}$ and the saturated liquid temperature $T_{LL}$ at the low-pressure side pressure $P_L$ with the following Equation (2) (ST6).

$$T_L'=T_{LL}\times(1-X)+T_{LG}\times X. \quad \text{Equation (2)}$$

The controller determines whether the calculated $T_L'$ is equal to the measured low-pressure side temperature $T_L$ (ST7). If not equal (ST7; not equal), the controller amends the assumed circulation composition α1 and α2 of the two refrigerant components (ST8) and repeats the process from ST4. On the other hand, if substantially equal (ST7; substantially equal), the controller deems that the circulation composition has been obtained and ends the process (ST9). With the process described above, the circulation composition of the two-component zeotropic refrigerant mixture can be obtained.

Note that as shown in FIG. 4 when the constant temperature line in the P-h diagram is substantially vertical in the subcooled liquid region on the left side of the saturated liquid line, the enthalpy $h_H$ can be computed with the high-pressure side temperature $T_H$ of the fourth temperature sensor 32 alone. As such, the second pressure sensor 37 will not be required and no problem will arise without he second pressure sensor 37.

Further, in a case of a three-component zeotropic refrigerant mixture, since an interrelationship is established between the ratio of two components among the three components, when the circulation composition of the two components are assumed, then the circulation composition of the other one of the components can be obtained. As such, it will be possible to obtain the circulation composition with a similar processing method.

Although an explanatory description has been given of a case in which a mixture of a mixed refrigerant of two components including HFO-1234yf and R32 is circulated, the invention is not limited to this. The refrigerant may be a mixed refrigerant of two other components having different boiling points or may be, added with other components, a mixed refrigerant of three or more components. It is possible to obtain the circulation composition with a similar method.

The bypass expansion device 42 may include an electronic expansion valve that can vary an opening degree or may include a capillary tube with a fixed throttling amount. Further, the refrigerant-to-refrigerant heat exchanger 43 may preferably be a double-pipe heat exchanger; however, not limited to this, a plate heat exchanger, a microchannel heat exchanger, or the like may be used. The heat exchanger may be any that can exchange heat between the high-pressure refrigerant and the low-pressure refrigerant. In FIG. 3, illustration has been made of a case in which the third pressure sensor 38 is disposed in the passage between the accumulator 19 and the first refrigerant flow switching device 11; however, not limited to this case, the third pressure sensor 38 may be disposed at any position that can measure the pressure on the low-pressure side of the compressor 10 such as a passage between the compressor 10 and the accumulator 19. Further, not limited to the illustrated position, the second pressure sensor 37 may also be disposed at any position that can measure the pressure on the high-pressure side of the compressor.

The circulation composition of the refrigerant can be measured as above. Furthermore, by measuring the pressure, the saturated liquid temperature and the saturated gas temperature at that pressure can be computed. By using the saturated liquid temperature and the saturated gas temperature, the mean temperature thereof can be obtained, for example. The mean temperature can be assumed as the saturation temperature at that pressure. This may be used to control the compressor 10 and the bypass expansion device 42. Note that the computing method of the saturation temperature is not just averaging the saturated liquid temperature and the saturated gas temperature. A weighted mean temperature obtained by multiplying a weighted coefficient by each of the saturated liquid temperature and the saturated gas temperature may be used since the heat transfer coefficient of the refrigerant differs according to the quality.

Further, on the low-pressure side (evaporator side), when the temperature of the two-phase refrigerant at the inlet of the evaporator is measured and this temperature is assumed as the saturated liquid temperature or the two-phase refrigerant temperature at the set quality, then the pressure, the saturated gas temperature, and the like can be obtained by a back-calculation of the relational expression that obtains the saturated liquid temperature and the saturated gas temperature from the circulation composition and the pressure. Accordingly, the pressure sensor is not essential. However, the temperature at the position where the temperature has been measured needs to be hypothesized as the saturated liquid temperature or the quality needs to be set; hence, the saturated liquid temperature and the saturated gas temperature can be obtained with better precision by using the pressure sensor.

Figure 8:
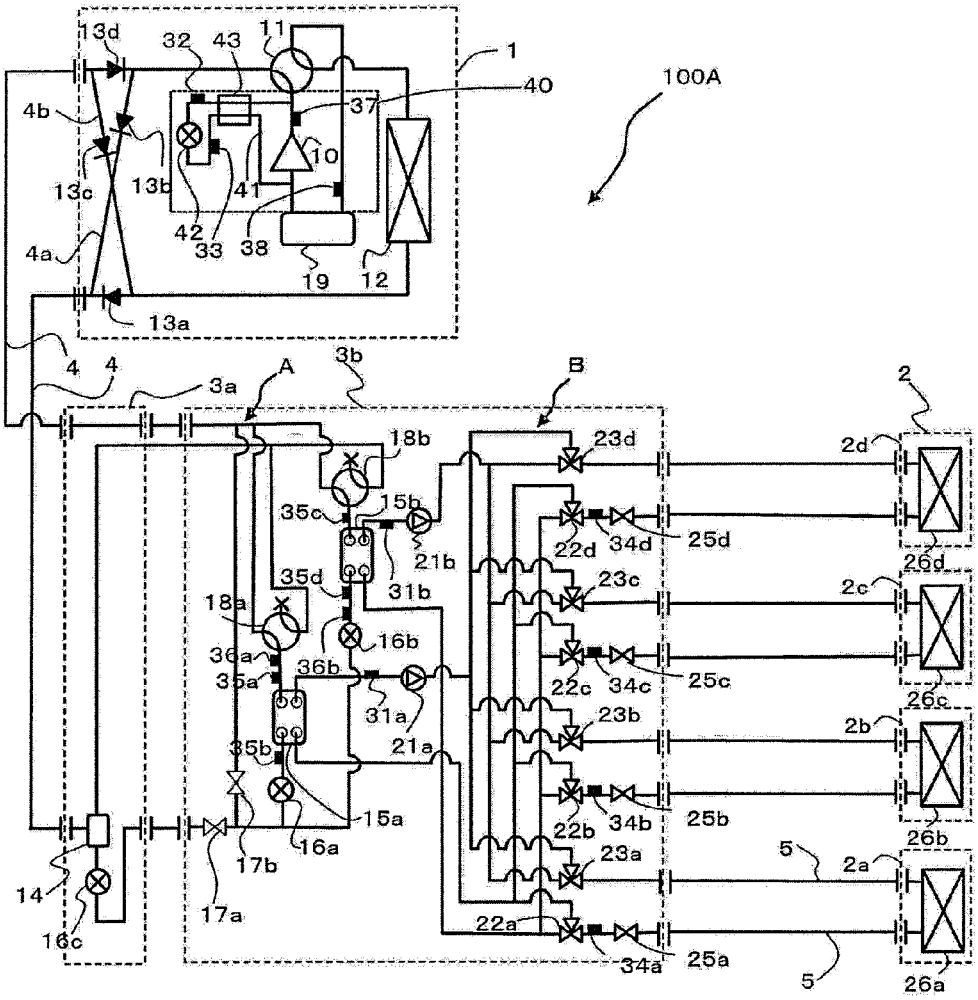
FIG. 8 is a schematic circuit diagram illustrating another exemplary circuit configuration of the air-conditioning apparatus according to the exemplary embodiment of the present invention.

FIG. 8 is a schematic circuit diagram illustrating another exemplary circuit configuration of the air-conditioning apparatus (hereinafter, referred to as an "air-conditioning apparatus 100A") according to the exemplary embodiment of the present invention. Referring to FIG. 8, the circuit configuration of the air-conditioning apparatus 100A will be described in which the heat medium relay unit 3 is separated into the main heat medium relay unit 3*a* and the sub heat medium relay unit 3*b*. As illustrated in FIG. 8, a housing of the heat medium relay unit 3 is separated such that the heat medium relay unit 3 is constituted by the main heat medium relay unit 3*a* and the sub heat medium relay unit 3*b*. This separation allows a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. Other components are arranged in the sub heat medium relay unit 3*b*. The gas-liquid separator 14 is connected to a single refrigerant pipe 4 connected to the outdoor unit 1 and is connected to two refrigerant pipes 4 connected to the heat exchanger related to heat medium 15*a* and the heat exchanger related to heat medium 15*b* in the sub heat medium relay unit 3*b*, and is configured to separate the heat source side refrigerant supplied from the outdoor unit 1 into vapor refrigerant and liquid refrigerant. The expansion device 16*c* disposed on the downstream side in the flow direction of the liquid refrigerant flowing out of the gas-liquid separator 14 has functions of a reducing valve and an expansion valve and reduces the pressure of and expands the heat source side refrigerant. During the cooling and heating mixed operation, the expansion device 16*c* is controlled such that an outlet thereof is at an intermediate pressure. The expansion device 16*c* may include a component having a variably controllable opening degree, such as an electronic expansion valve. This arrangement allows a plurality of sub heat medium relay units 3*b* to be connected to the main heat medium relay unit 3*a*.

Various operation modes executed by the air-conditioning apparatus 100 will be described. The air-conditioning apparatus 100 allows each indoor unit 2 to perform a cooling operation or a heating operation on the basis of a command from the indoor unit 2. Specifically, the air-conditioning apparatus 100 allows all of the indoor units 2 to perform the same operation and also allows each of the indoor units 2 to perform different operations. It should be noted that since the various operation modes are carried out in a similar manner by the air-conditioning apparatus 100A, description of the various operation modes carried out by the air-conditioning apparatus 100A is omitted. In the following description, the air-conditioning apparatus 100 includes the air-conditioning apparatus 100A.

The operation modes carried out by the air-conditioning apparatus 100 includes the cooling only operation mode in which all of the operating indoor units 2 perform the cooling operation, the heating only operation mode in which all of the operating indoor units 2 perform the heating operation, the cooling main operation mode, which is one of the cooling and heating mixed operation modes in which the cooling load is larger than the heating load, and a heating main operation mode, which is another one of the cooling and heating mixed operation modes in which the heating load is larger than the cooling load. The various operation modes will be described below with respect to the flow of the heat source side refrigerant and that of the heat medium.

[Cooling Only Operation Mode]

Figure 9:
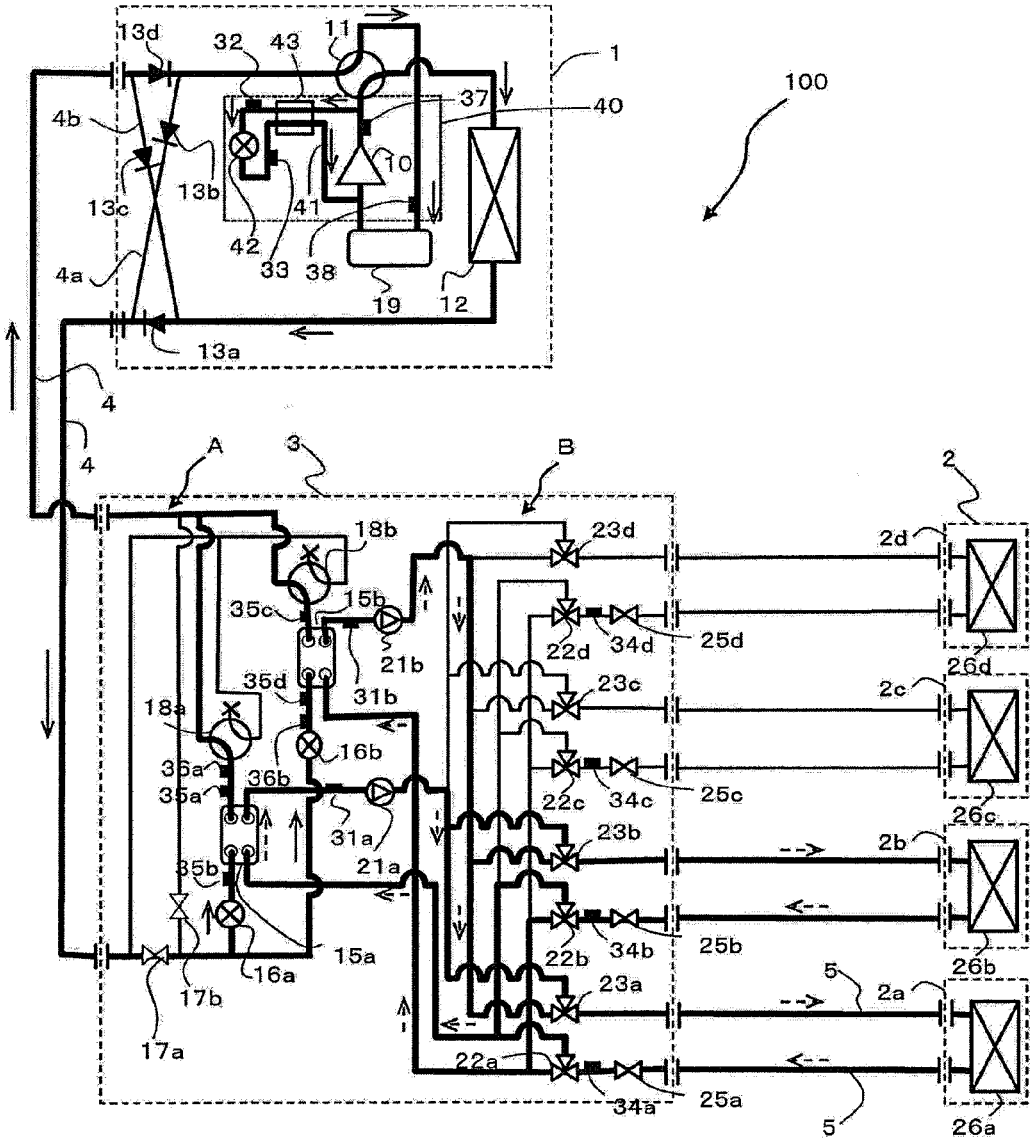
FIG. 9 is a refrigerant circuit diagram illustrating flows of refrigerants in a cooling only operation mode of the air-conditioning apparatus according to the exemplary embodiment of the present invention.

FIG. 9 is a refrigerant circuit diagram illustrating the flow of the refrigerants in the cooling only operation mode of the air-conditioning apparatus 100. The cooling only operation mode will be described with respect to a case in which cooling loads are generated only in the use side heat exchanger 26*a* and the use side heat exchanger 26*b* in FIG. 9. Furthermore, in FIG. 9, pipes indicated by thick lines indicate the pipes through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 9.

In the cooling only operation mode illustrated in FIG. 9, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant. The high-temperature high-pressure gas refrigerant that has been discharged from the compressor 10 flows through the first refrigerant flow switching device 11 into the heat source side heat exchanger 12. Then, the refrigerant is condensed and liquefied into a high-pressure liquid refrigerant while transferring heat to outdoor air in the heat source side heat exchanger 12. The high-pressure liquid refrigerant flowing out of the heat source side heat exchanger 12 passes through the check valve 13*a*, flows out of the outdoor unit 1, passes through the refrigerant pipe 4, and flows into the heat medium relay unit 3. The high-pressure liquid refrigerant that has flowed into the heat medium relay unit 3 is branched after passing through the on-off device 17*a* and is expanded into a low-temperature low-pressure two-phase refrigerant by the expansion device 16*a* and the expansion device 16*b*.

This two-phase refrigerant flows into each of the heat exchanger related to heat medium 15*a*, and the heat exchanger related to heat medium 15*b* acting as evaporators, absorbs heat from the heat medium circulating in the heat medium circuit B, cools the heat medium, and turns into a low-temperature low-pressure gas refrigerant. The gas refrigerant, which has flowed out of each of the heat exchanger related to heat medium 15*a* and the heat exchanger related to heat medium 15*b*, flows out of the heat medium relay unit 3 through the corresponding second refrigerant flow switching device 18*a* and second refrigerant flow switching device 18*b*, passes through the refrigerant pipe 4, and flows into the outdoor unit 1 again. The refrigerant that has flowed into the outdoor unit 1 passes through the check valve 13*d*, the first refrigerant flow switching device 11, and the accumulator 19, and is sucked into the compressor 10 again.

The circulation composition of the refrigerant circulating in the refrigeration cycle is measured by using the circulation composition detection means 40. Further, the controller (not shown) of the outdoor unit 1 and the controller (not shown) of the heat medium relay unit 3 are connected by wire or are connected wirelessly allowing communication therebetween. The circulation composition detected in the outdoor unit 1 is transmitted through communication from the controller of the outdoor unit 1 to the controller of the heat medium relay unit 3. Note that the controller of the outdoor unit 1 and the controller of the heat medium relay unit 3 may be constituted as a single controller.

The opening degree of the expansion device 16*a* is controlled by the controller such that superheat (the degree of superheat) is constant in which the superheat is obtained as a temperature difference between the detection temperature of the third temperature sensor 35*a* and the computed evaporating temperature obtained as a mean temperature between the saturated liquid temperature and the saturated gas temperature that are computed from the circulation composition transmitted from the outdoor unit 1 through communication and from the detection pressure of the first pressure sensor 36*a*. Similarly, the opening degree of the expansion device 16*b* is controlled by the controller such that the superheat is constant in which the superheat is obtained as a temperature difference between the detection temperature of the third temperature sensor 35*c* and the computed evaporating temperature. In addition, the on-off device 17*a* is opened and the on-off device 17*b* is closed.

Note that, by hypothesizing the detection temperature of the third temperature sensor 35*b* as a saturated liquid temperature or as a temperature at the set quality, the saturation pressure and the saturated gas temperature may be computed from the circulation composition transmitted from the outdoor unit 1 through communication and the detection temperature of the third temperature sensor 35*b*. The saturation temperature may be obtained as the mean temperature between the saturated liquid temperature and the saturated gas temperature, and this may be used to control the expansion device 16*a* and the expansion device 16*b*. In such a case, there is no need to dispose the first pressure sensor 36, and, thus, the system can be configured inexpensively.

Next, the flow of the heat medium in the heat medium circuit B will be described.

In the cooling only operation mode, both the heat exchanger related to heat medium 15*a* and the heat exchanger related to heat medium 15*b* transfer cooling energy of the heat source side refrigerant to the heat medium, and the pump 21*a* and the pump 21*b* allow the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air in the use side heat exchanger 26*a* and the use side heat exchanger 26*b*, thus cooling the indoor space 7.

Then, the heat medium flows out of the use side heat exchanger 26*a* and the use side heat exchanger 26*b* and flows into the heat medium flow control device 25*a* and the heat medium flow control device 25*b*. At this time, with the function of the heat medium flow control device 25*a* and the heat medium flow control device 25*b*, the heat medium flowing into each of the use side heat exchanger 26*a* and the use side heat exchanger 26*b* is controlled to a flow rate that is sufficient to cover an air conditioning load required in the indoor space. The heat medium that has flowed out of the heat medium flow control device 25*a* and the heat medium flow control device 25*b* passes through the first heat medium flow switching device 22*a* and the first heat medium flow switching device 22*b* respectively, flows into the heat exchanger related to heat medium 15*a* and the heat exchanger related to heat medium 15*b*, and is sucked into the pump 21*a* and the pump 21*b* again.

Note that in the pipes 5 of the use side heat exchanger 26, the heat medium is directed to flow from the second heat medium flow switching device 23 to the first heat medium flow switching device 22 through the heat medium flow control device 25. The air conditioning load required in the indoor space 7 can be covered by controlling the difference between the temperature detected by the first temperature sensor 31*a* or the temperature detected by the first temperature sensor 31*b*, and a temperature detected by the second temperature sensor 34 to be maintained at a target value. As regards the temperature at the outlet of each heat exchanger related to heat medium 15, either of the temperature detected by the first temperature sensor 31*a* or that detected by the first temperature sensor 31*b* may be used. Alternatively, the mean temperature of the two may be used. At this time, the first heat medium flow switching device 22 and the second heat medium flow switching device 23 are set to a medium opening degree such that passages to both of the heat exchanger related to heat medium 15*a* and the heat exchanger related to heat medium 15*b* are established.

Upon carrying out the cooling only operation mode, since it is unnecessary to supply the heat medium to each use side heat exchanger 26 having no heat load (including thermostat off), the passage is closed by the corresponding heat medium flow control device 25 such that the heat medium does not flow into the corresponding use side heat exchanger 26. In FIG. 9, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Incidentally, the refrigerant is a zeotropic refrigerant mixture, and the saturated gas temperature exhibits a higher temperature than the saturated liquid temperature at the same pressure. As such, the inlet side temperature of each of the heat exchanger related to heat medium 15*a* and the heat exchanger related to heat medium 15*b* functioning as an evaporator, that is, the detection temperature of each of the third temperature sensor 35*b* and the third temperature sensor 35*d*, exhibits the lowest temperature. Further, the refrigerant temperature inside each of the heat exchanger related to heat medium 15*a* and the heat exchanger related to heat medium 15*b* gradually increases approaching the outlet. Accordingly, it can be understood that in order to prevent freezing of the heat medium that is exchanging heat with the refrigerant in each of the heat exchanger related to heat medium 15*a* and the heat exchanger related to heat medium 15*b*, control may be performed such that the detection temperature of each of the third temperature sensor 35*b* and the third temperature sensor 35*d* does not fall below the freezing temperature of the heat medium. Efficient prevention of freezing of the heat medium improves safety.

However, since heat is exchanged in the entire heat exchanger related to heat medium 15*a* and heat exchanger related to heat medium 15*b*, the mean temperature of the refrigerant in each of the heat exchanger related to heat medium 15*a* and the heat exchanger related to heat medium 15*b* needs to be treated as the representative temperature of the heat exchange. This mean temperature is higher than the detected temperature of the third temperature sensor 35*b* and the third temperature sensor 35*d*. Accordingly, if an anti-freezing control is performed with the detection temperature of the third temperature sensor 35*b* and the third temperature sensor 35*d* at all times irrespective of the operating state, it will not be possible to control the refrigerant temperature to be lower than the detection temperature of the third temperature sensor 35*b* and the third temperature sensor 35*d*. As such, a countermeasure regarding the cooling capacity will be required when there is an intent to control the temperature of the heat medium at a low temperature.

In a state in which the heat exchanger related to heat medium 15*a* and the heat exchanger related to heat medium 15*b* are acting as evaporators, the refrigerant and the heat medium that are exchanging heat flow in parallel such that the refrigerant on the inlet side and the heat medium on the inlet side correspond to each other and the refrigerant on the outlet side and the heat medium on the outlet side correspond to each other. At this time, since the heat medium that has absorbed heat in the use side heat exchanger 26*a* and the use side heat exchanger 26*b* flows into the heat exchanger related to heat medium 15*a* and the heat exchanger related to heat medium 15*b* in a heated state, the heat medium on the inlet side of each of the heat exchanger related to heat medium 15*a* and the heat exchanger related to heat medium 15*b* is higher in temperature than the heat medium on the outlet side thereof. The higher the temperature of the heat medium, a situation in which the heat medium is frozen and clogs the heat medium passage is less likely to occur unless the temperature of the refrigerant exchanging heat therewith is at a further lower temperature.

That is, in the heat exchanger related to heat medium 15*a* and the heat exchanger related to heat medium 15*b*, the refrigerant and the heat medium exchange heat while flowing in parallel to each other such that on the inlet side, the heat medium with high temperature and the refrigerant with low temperature exchange heat, and such that while approaching the outlet side, the temperature of the heat medium is reduced and the temperature of the refrigerant is increased. Accordingly, on the inlet side of the heat exchanger related to heat medium 15*a* and heat exchanger related to heat medium 15*b*, the refrigerant temperature is low and the heat medium temperature is high; hence, a state in which the heat medium becomes frozen and the heat medium passage becomes clogged is not easily reached.

Now, occurrence of heat medium freezing is estimated by setting a positive value larger than zero as a freezing temperature correction value and setting a value obtained by subtracting the freezing temperature correction value from the detection temperature of each of the third temperature sensor 35*b* and the third temperature sensor 35*d* as an anti-freezing temperature. If anti-freezing control is made to be performed when the refrigerant temperature drops below the anti-freezing temperature, then it will be possible to exert sufficient cooling capacity even when the target temperature of the heat medium is low. Since the representative temperature of the refrigerant in each of the heat exchanger related to heat medium 15*a* and the heat exchanger related to heat medium 15*b* during heat exchange is the mean temperature between the saturated liquid temperature and the saturated gas temperature that are computed from the circulation composition, in general, setting of the freezing temperature correction value to substantially one half of the temperature difference between the saturated gas temperature and the saturated liquid temperature allows the heat exchanger related to heat medium 15 and the heat exchanger related to heat medium 15*b* to be used most effectively, and thus is preferable.

However, when the temperature difference between the heat medium on the inlet side and outlet side of each of the heat exchanger related to heat medium 15*a* and heat exchanger related to heat medium 15*b* is small, anti-freezing control needs to be performed at a somewhat higher temperature. As such, the temperature difference between the saturated gas refrigerant temperature and the saturated liquid refrigerant temperature may be multiplied by a coefficient or a value obtained by multiplying a weighting coefficient by the saturated gas refrigerant temperature and the saturated liquid refrigerant temperature may be set as the freezing temperature correction value. Note that the freezing temperature correction value may be obtained by the saturated gas temperature and the saturated liquid temperature computed from the circulation composition, or the correspondence between the circulation composition and the freezing temperature correction value may be stored. In the latter case, the number of computations can be reduced.

The anti-freezing control may be any method that can increase the temperature of the heat medium flowing in the heat exchanger related to heat medium 15*a* and the heat exchanger related to heat medium 15*b* and control the heat medium to be at a higher temperature than the temperature in which the heat medium freezes and clogs the heat medium passage. For example, the drive frequency of the compressor 10 may be reduced or the compressor 10 may be stopped, or the opening degree of at least one of the expansion device 16*a* and the expansion device 16*b* may be increased. Note that when the drive frequency of the compressor 10 is controlled on the basis of the evaporating temperature corresponding to the detection pressure of the third pressure sensor 38, it is possible to reduce the drive frequency of the compressor 10 by setting a higher target evaporating temperature.

Further, prevention of freezing of the heat exchanger related to heat medium 15*a* or the heat exchanger related to heat medium 15*b* may be carried out by reducing the opening degree of the expansion device 16*a* or the expansion device 16*b* to set the refrigerant passage to a nearly closed state such that no refrigerant flows into the heat exchanger related to heat medium 15*a* or the heat exchanger related to heat medium 15*b*. Furthermore, freezing may be prevented by increasing the refrigerant temperature by making either or both of the heat exchanger related to heat medium 15*a* and the heat exchanger related to heat medium 15*b* that are functioning as evaporators function as condensers.

Note that the freezing temperature of the heat medium, that is, the temperature in which the heat medium freezes and clogs the heat medium passage, is 0° C. when the heat medium is water and the flow velocity is zero; however, when the flow velocity is high, the freezing temperature becomes a lower temperature that is below 0° C.

[Heating Only Operation Mode]

Figure 10:
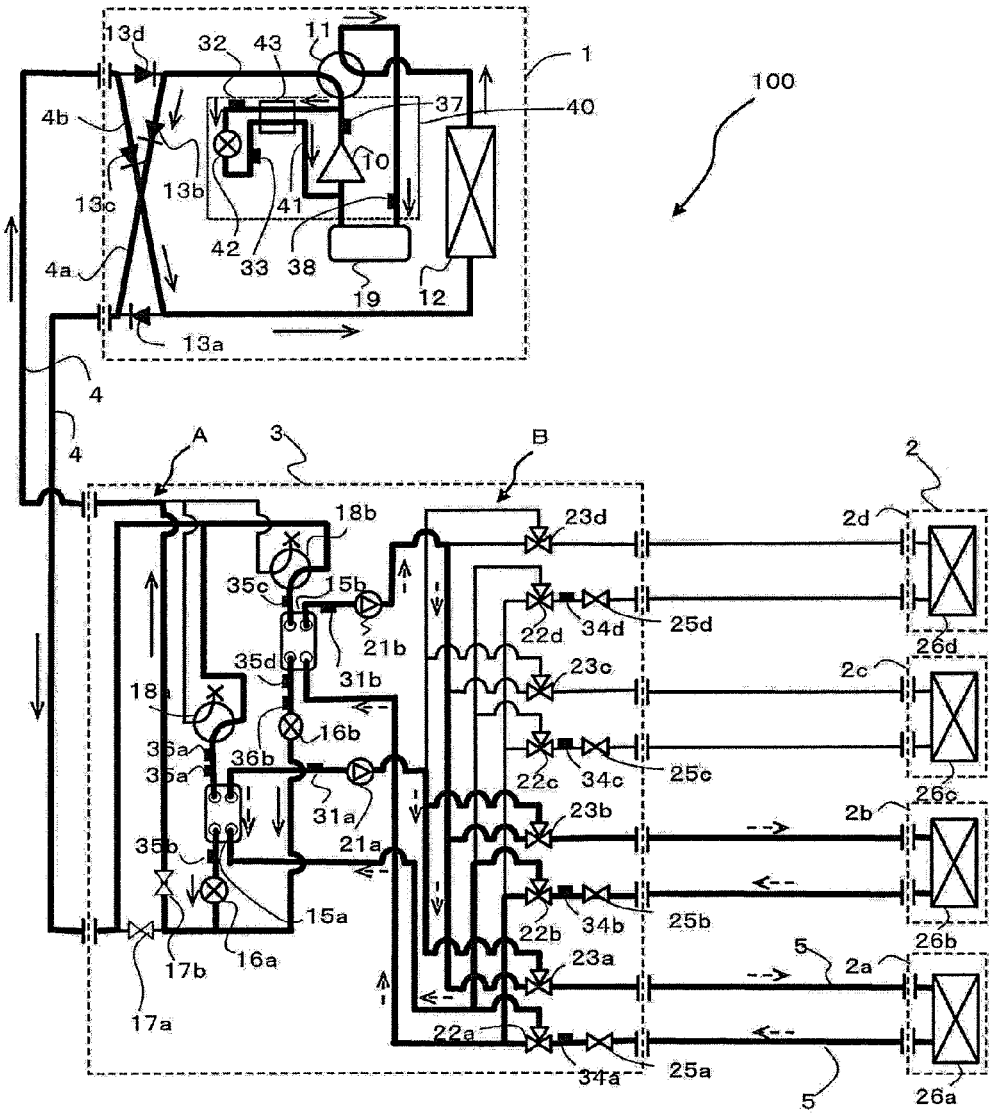
FIG. 10 is a refrigerant circuit diagram illustrating flows of refrigerants in a heating only operation mode of the air-conditioning apparatus according to the exemplary embodiment of the present invention.

FIG. 10 is a refrigerant circuit diagram illustrating the flows of the refrigerants in the heating only operation mode of the air-conditioning apparatus 100. The heating only operation mode will be described with respect to a case in which heating loads are generated only in the use side heat exchanger 26*a* and the use side heat exchanger 26*b* in FIG. 10. Furthermore, in FIG. 10, pipes indicated by thick lines indicate the pipes through which the refrigerants (the heat source side refrigerant and the heat medium) flow. In addition, the direction of flow of the heat source side refrigerant is indicated by solid-line arrows and the direction of flow of the heat medium is indicated by broken-line arrows in FIG. 10.

In the heating only operation mode illustrated in FIG. 10, the first refrigerant flow switching device 11 is switched such that the heat source side refrigerant discharged from the compressor 10 flows into the heat medium relay unit 3 without passing through the heat source side heat exchanger 12 in the outdoor unit 1. In the heat medium relay unit 3, the pump 21*a*, and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between each of the heat exchanger related to heat medium 15*a* and the heat exchanger related to heat medium 15*b* and each of the use side heat exchanger 26*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant. The high-temperature high-pressure gas refrigerant that has been discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant that has flowed out of the outdoor unit 1 passes through the refrigerant pipe 4 and flows into the heat medium relay unit 3. The high-temperature high-pressure gas refrigerant that has flowed into the heat medium relay unit 3 is branched, passes through the second refrigerant flow switching device 18*a* and the second refrigerant flow switching device 18*b*, and flows into the heat exchanger related to heat medium 15*a* and the heat exchanger related to heat medium 15*b*, respectively.

The high-temperature high-pressure gas refrigerant that has flowed into each of the heat exchanger related to heat medium 15*a* and the heat exchanger related to heat medium 15*b* is condensed and liquefied into a high-pressure liquid refrigerant while transferring heat to the heat medium circulating in the heat medium circuit B. The liquid refrigerant flowing out of the heat exchanger related to heat medium 15*a* and out of the heat exchanger related to heat medium 15*b* is expanded into a low-temperature low-pressure, two-phase refrigerant in the expansion device 16*a* and the expansion device 16*b*, respectively. This two-phase refrigerant passes through the on-off device 17*b*, flows out of the heat medium relay unit 3, passes through the refrigerant pipe 4, and flows into the outdoor unit 1 again. The refrigerant that has flowed into the outdoor unit 1 flows through the second connecting pipe 4*b*, passes through the check valve 13*c*, and flows into the heat source side heat exchanger 12 functioning as an evaporator.

Then, the heat source side refrigerant that has flowed into the heat source side heat exchanger 12 removes heat from the outdoor air in the heat source side heat exchanger 12 and turns into a low-temperature low-pressure gas refrigerant. The low-temperature low-pressure gas refrigerant flowing out of the heat source side heat exchanger 12 passes through the first refrigerant flow switching device 11 and the accumulator 19, and is sucked into the compressor 10 again.

The circulation composition of the refrigerant circulating in the refrigeration cycle is measured by using the circulation composition detection means 40. Further, the controller (not shown) of the outdoor unit 1 and the controller (not shown) of the heat medium relay unit 3 are connected by wire or are connected wirelessly allowing communication therebetween. The circulation composition detected in the outdoor unit 1 is transmitted through communication from the controller of the outdoor unit 1 to the controller of the heat medium relay unit 3. Note that the controller of the outdoor unit 1 and the controller of the heat medium relay unit 3 may be constituted as a single controller.

The opening degree of the expansion device 16*a* is controlled by the controller such that subcooling (degree of subcooling) is constant, with the subcooling being obtained as a temperature difference between the detection temperature of the third temperature sensor 35*b* and the computed condensing temperature obtained as a mean temperature between the saturated liquid temperature and the saturated gas temperature that are computed from the circulation composition transmitted from the outdoor unit 1 through communication and from the detection pressure of the first pressure sensor 36*a*. Similarly, the opening degree of the expansion device 16*b* is controlled by the controller such that the subcooling is constant, with the subcooling being obtained as a temperature difference between the computed condensing temperature and the detection temperature of the third temperature sensor 35*d*. In addition, the on-off device 17*a* is closed and the on-off device 17*b* is opened.

Note that, by hypothesizing the detection temperature of the third temperature sensor 35*b* as a saturated liquid temperature or as a temperature at the set quality, the saturation pressure and the saturated gas temperature may be computed from the circulation composition transmitted from the outdoor unit 1 through communication and the detection temperature of the third temperature sensor 35*b*. The saturation temperature may be obtained as the mean temperature between the saturated liquid temperature and the saturated gas temperature, and this may be used to control the expansion device 16*a* and the expansion device 16*b*. In such a case, there is no need to dispose the first pressure sensor 36, and, thus, the system can be configured inexpensively.

Next, the flow of the heat medium in the heat medium circuit B will be described.

In the heating only operation mode, both of the heat exchanger related to heat medium 15*a* and the heat exchanger related to heat medium 15*b* transfer heating energy of the heat source side refrigerant to the heat medium, and the pump 21*a* and the pump 21*b* allow the heated heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. Then the heat medium transfers heat to the indoor air in the use side heat exchanger 26*a* and the use side heat exchanger 26*b*, thus heats the indoor space 7.

Then, the heat medium flows out of the use side heat exchanger 26*a* and the use side heat exchanger 26*b* and flows into the heat medium flow control device 25*a* and the heat medium flow control device 25*b*. At this time, with the function of the heat medium flow control device 25*a* and the heat medium flow control device 25*b*, the heat medium flowing into each of the use side heat exchanger 26*a* and the use side heat exchanger 26*b* is controlled to a flow rate that is sufficient to cover an air conditioning load required in the indoor space. The heat medium, which has flowed out of the heat medium flow control device 25*a* and the heat medium flow control device 25*b*, passes through the first heat medium flow switching device 22*a* and the first heat medium flow switching device 22*b*, respectively, flows into the heat exchanger related to heat medium 15*a* and the heat exchanger related to heat medium 15*b*, and is again sucked into the pump 21*a* and the pump 21*b*.

Note that in the pipes 5 of the use side heat exchanger 26, the heat medium is directed to flow from the second heat medium flow switching device 23 to the first heat medium flow switching device 22 through the heat medium flow control device 25. The air conditioning load required in the indoor space 7 can be covered by controlling the difference between the temperature detected by the first temperature sensor 31*a* or the temperature detected by the first temperature sensor 31*b*, and a temperature detected by the second temperature sensor 34 to be maintained at a target value. As regards the temperature at the outlet of each heat exchanger related to heat medium 15, either of the temperature detected by the first temperature sensor 31*a* or that detected by the first temperature sensor 31*b* may be used. Alternatively, the mean temperature of the two may be used.

At this time, each of the first heat medium flow switching device 22 and the second heat medium flow switching device 23 is set to a medium opening degree such that passages to both of the heat exchanger related to heat medium 15*a* and the heat exchanger related to heat medium 15*b* are established. Although the use side heat exchanger 26*a* should essentially be controlled with the temperature difference between the inlet and the outlet, since the temperature of the heat medium on the inlet side of the use side heat exchanger 26 is substantially the same as that detected by the first temperature sensor 31*b*, the use of the first temperature sensor 31*b* can reduce the number of temperature sensors, so that the system can be configured inexpensively.

Upon carrying out the heating only operation mode, since it is unnecessary to supply the heat medium to each use side heat exchanger 26 having no heat load (including thermostat off), the passage is closed by the corresponding heat medium flow control device 25 such that the heat medium does not flow into the corresponding use side heat exchanger 26. In FIG. 10, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 11:
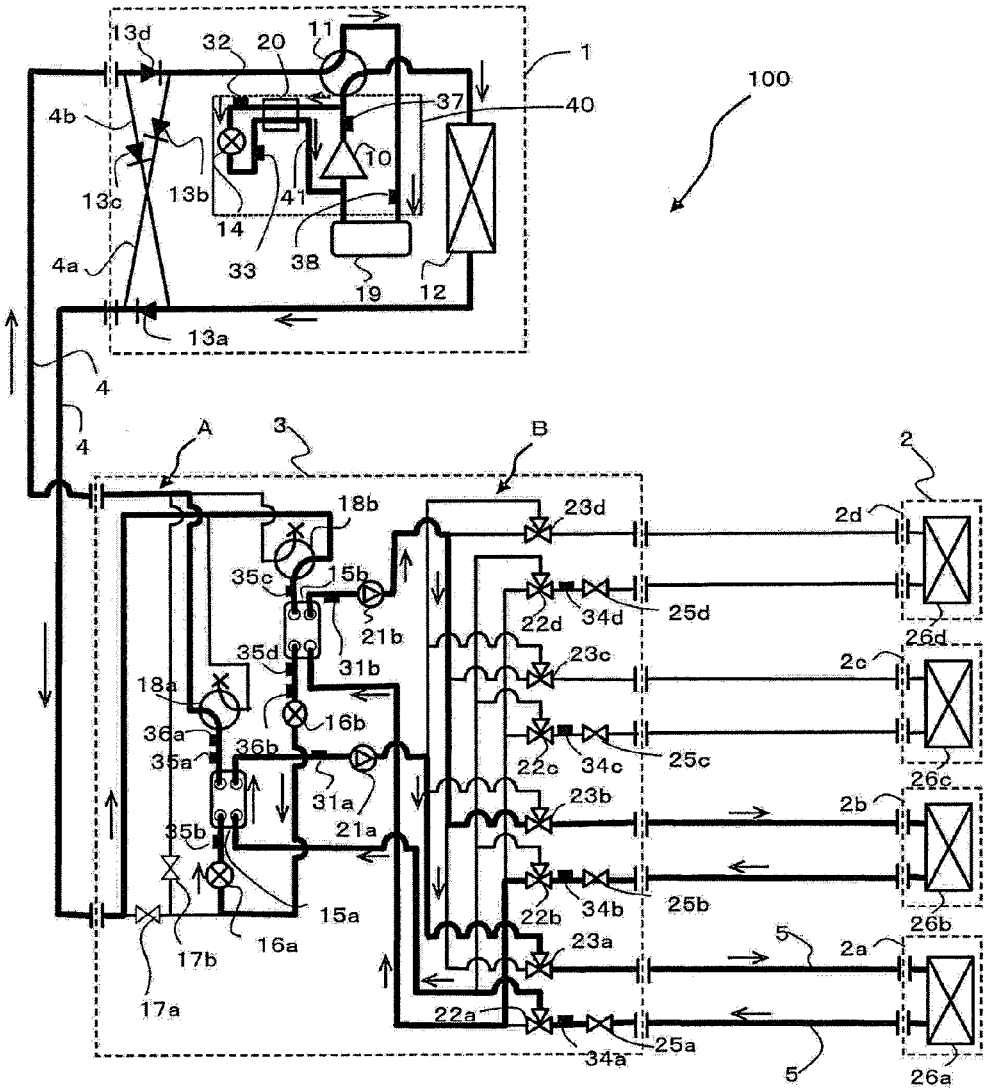
FIG. 11 is a refrigerant circuit diagram illustrating flows of refrigerants in a cooling main operation mode of the air-conditioning apparatus according to the exemplary embodiment of the present invention.

FIG. 11 is a refrigerant circuit diagram illustrating the flows of the refrigerants in the cooling main operation mode of the air-conditioning apparatus 100. The cooling main operation mode will be described with respect to a case in which a cooling load is generated in the use side heat exchanger 26*a* and a heating load is generated in the use side heat exchanger 26*b* in FIG. 11. Furthermore, in FIG. 11, pipes indicated by thick lines correspond to pipes through which the refrigerants (the heat source side refrigerant and the heat medium) circulate. In addition, the direction of flow of the heat source side refrigerant is indicated by solid-line arrows and the direction of flow of the heat medium is indicated by broken-line arrows in FIG. 11.

In the cooling main operation mode illustrated in FIG. 11, the first refrigerant flow switching device 11 is switched such that the heat source side refrigerant discharged from the compressor 10 flows into the heat source side heat exchanger 12 in the outdoor unit 1. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchanger related to heat medium 15*a* and the use side heat exchanger 26*a*, and between the heat exchanger related to heat medium 15*b* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant. The high-temperature high-pressure gas refrigerant that has been discharged from the compressor 10 flows through the first refrigerant flow switching device 11 into the heat source side heat exchanger 12. The refrigerant is condensed into a two-phase refrigerant in the heat source side heat exchanger 12 while transferring heat to the outside air. The two-phase refrigerant flowing out of the heat source side heat exchanger 12 passes through the check valve 13*a*, flows out of the outdoor unit 1, passes through the refrigerant pipe 4, and flows into the heat medium relay unit 3. The two-phase refrigerant flowing into the heat medium relay unit 3 passes through the second refrigerant flow switching device 18*b* and flows into the heat exchanger related to heat medium 15*b* functioning as a condenser.

The two-phase refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* absorbs heat from the heat medium circulating in the heat medium circuit B, cools the heat medium, and turns into a low-pressure gas refrigerant. The gas refrigerant flows out of the heat exchanger related to heat medium 15*a*, passes through the second refrigerant flow switching device 18*a*, flows out of the heat medium relay unit 3, and flows into the outdoor unit 1 again through the refrigerant pipe 4. The heat source side refrigerant that has flowed into the outdoor unit 1 passes through the check valve 13*d*, the first refrigerant flow switching device 11, and the accumulator 19, and is sucked into the compressor 10 again.

The circulation composition of the refrigerant circulating in the refrigeration cycle is measured by using the circulation composition detection means 40. Further, the controller (not shown) of the outdoor unit 1 and the controller (not shown) of the heat medium relay unit 3 are connected by wire or wireless allowing communication therebetween. The circulation composition detected in the outdoor unit 1 is transmitted through communication from the controller of the outdoor unit 1 to the controller of the heat medium relay unit 3. Note that the controller of the outdoor unit 1 and the controller of the heat medium relay unit 3 may be constituted as a single controller.

The opening degree of the expansion device 16*b* is controlled by the controller such that superheat (degree of superheat) is constant, with the superheat being obtained as a temperature difference between the detection temperature of the third temperature sensor 35*a* and the computed evaporating temperature obtained as a mean temperature between the saturated liquid temperature and the saturated gas temperature that are computed from the circulation composition transmitted from the outdoor unit 1 through communication and from the detection pressure of the first pressure sensor 36*b*. In addition, the expansion device 16*a* is fully opened, the on-off device 17*a* is closed, and the on-off device 17*b* is closed.

The opening degree of the expansion device 16*b* is controlled by the controller such that subcooling (degree of subcooling) is constant, with the subcooling being obtained as a temperature difference between the detection temperature of the third temperature sensor 35*d* and the computed condensing temperature obtained as a mean temperature between the saturated liquid temperature and the saturated gas temperature that are computed from the circulation composition transmitted from the outdoor unit 1 through communication and from the detection pressure of the first pressure sensor 36*b*. Alternatively, the expansion device 16*b* may be fully opened and the expansion device 16*a* may control the superheat or the subcooling.

Further, by hypothesizing the detection temperature of the third temperature sensor 35*b* as a saturated liquid temperature or as a temperature at the set quality, the saturation pressure and the saturated gas temperature may be computed from the circulation composition transmitted from the outdoor unit 1 through communication and the detection temperature of the third temperature sensor 35*b*. The saturation temperature may be obtained as the mean temperature between the saturated liquid temperature and the saturated gas temperature, and this may be used to control the expansion device 16*a* or the expansion device 16*b*. In such a case, there is no need to dispose the first pressure sensor 36, and, thus, the system can be configured inexpensively.

Next, the flow of the heat medium in the heat medium circuit B will be described.

In the cooling main operation mode, the heat exchanger related to heat medium 15*b* transfers heating energy of the heat source side refrigerant to the heat medium, and the pump 21*b* allows the heated heat medium to flow through the pipes 5. Furthermore, in the cooling main operation mode, the heat exchanger related to heat medium 15*a* transfers cooling energy of the heat source side refrigerant to the heat medium, and the pump 21*a* allows the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium transfers heat to the indoor air, thus heats the indoor space 7. In addition, in the use side heat exchanger 26*a*, the heat medium absorbs heat from the indoor air, thus cools the indoor space 7. At this time, with the function of each of the heat medium flow control device 25*a* and the heat medium flow control device 25*b*, the heat medium flowing into the corresponding one of the use side heat exchanger 26*a* and the use side heat exchanger 26*b* is controlled to a flow rate that is sufficient to cover an air conditioning load required in the indoor space. The heat medium, which has passed through the use side heat exchanger 26*b* with a slight decrease of temperature, passes through the heat medium flow control device 25*b* and the first heat medium flow switching device 22*b*, flows into the heat exchanger related to heat medium 15*b*, and is sucked into the pump 21*b* again. The heat medium, which has passed through the use side heat exchanger 26*a* with a slight increase of temperature, passes through the heat medium flow control device 25*a* and the first heat medium flow switching device 22*a*, flows into the heat exchanger related to heat medium 15*a*, and is sucked into the pump 21*a* again.

During this time, with the function of the first heat medium flow switching devices 22 and the second heat medium flow switching devices 23, the heated heat medium and the cooled heat medium are introduced to the respective use side heat exchangers 26 having a heating load and a cooling load, without being mixed. Note that in the pipes 5 on both the heating side and the cooling side of each use side heat exchanger 26, the heat medium is directed to flow from the second heat medium flow switching device 23 through the heat medium flow control device 25 to the first heat medium flow switching device 22. Furthermore, each air conditioning load required in the indoor space 7 is covered by controlling the temperature difference between the temperature detected by the first temperature sensor 31*b* and that detected by the second temperature sensor 34 at a target value for the heating side, and is covered by controlling the temperature difference between the temperature detected by the second temperature sensor 34 and that detected by the first temperature sensor 31*a* at a target value for the cooling side.

Upon carrying out the cooling main operation mode, since it is unnecessary to supply the heat medium to each use side heat exchanger 26 having no heat load (including thermostat off), the passage is closed by the corresponding heat medium flow control device 25 such that the heat medium does not flow into the corresponding use side heat exchanger 26. In FIG. 11, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Incidentally, the refrigerant is a zeotropic refrigerant mixture, and the saturated gas temperature exhibits a higher temperature than the saturated liquid temperature at the same pressure. As such, the inlet side temperature of the heat exchanger related to heat medium 15*a* functioning as an evaporator, that is, the detection temperature of the third temperature sensor 35*b*, exhibits the lowest temperature. Further, the refrigerant temperature inside the heat exchanger related to heat medium 15*a* gradually increases as the refrigerant approaches the outlet. Accordingly, it can be understood that in order to prevent freezing of the heat medium that is exchanging heat with the refrigerant in the heat exchanger related to heat medium 15*a*, control may be performed such that the detection temperature of the third temperature sensor 35*b* does not fall below the freezing temperature of the heat medium. Efficient prevention of freezing of the heat medium allows safety to be improved.

However, since heat is exchanged in the entire heat exchanger related to heat medium 15*a*, the mean temperature of the refrigerant in the heat exchanger related to heat medium 15*a* needs to be treated as the representative temperature. This mean temperature is higher than the detected temperature of the third temperature sensor 35*b*. Accordingly, if an anti-freezing control is performed with the detection temperature of the third temperature sensor 35*b* at all times irrespective of the operating state, it will not be possible to control the refrigerant temperature to be lower than the detection temperature of the third temperature sensor 35*b*. As such, a countermeasure regarding the cooling capacity will be required when there is an intent to control the temperature of the heat medium at a low temperature.

In a state in which the heat exchanger related to heat medium 15*a* is acting as an evaporator, the refrigerant and the heat medium that are exchanging heat flow in parallel such that the refrigerant on the inlet side and the heat medium on the inlet side correspond to each other and the refrigerant on the outlet side and the heat medium on the outlet side correspond to each other. At this time, since the heat medium that has absorbed heat in the use side heat exchanger 26*a* flows into the heat exchanger related to heat medium 15*a* in a heated state, the heat medium on the inlet side of the heat exchanger related to heat medium 15*a* is higher in temperature than the heat medium on the outlet side thereof. The higher the temperature of the heat medium, a situation in which the heat medium is frozen and clogs the heat medium passage is less likely to occur unless the temperature of the refrigerant exchanging heat therewith is at a further lower temperature.

That is, in the heat exchanger related to heat medium 15*a*, the refrigerant and the heat medium exchange heat while flowing in parallel to each other such that on the inlet side, the heat medium with high temperature and the refrigerant with low temperature exchange heat, and such that while approaching the outlet side, the temperature of the heat medium is reduced and the temperature of the refrigerant is increased. Accordingly, on the inlet side of the heat exchanger related to heat medium 15*a*, the refrigerant temperature is low and the heat medium temperature is high; hence, a state in which the heat medium becomes frozen and the heat medium passage becomes clogged is not easily reached.

Now, occurrence of heat medium freezing is estimated by setting a positive value larger than zero as a freezing temperature correction value and setting a value obtained by subtracting the freezing temperature correction value from the detection temperature of the third temperature sensor 35*b* as an anti-freezing temperature. If anti-freezing control is made to be performed when the refrigerant temperature drops below the anti-freezing temperature, then it will be possible to exert sufficient cooling capacity even when the target temperature of the heat medium is low. Since the representative temperature of the refrigerant in the heat exchanger related to heat medium 15*a* during heat exchange is the mean temperature between the saturated liquid temperature and the saturated gas temperature that are computed from the circulation composition, in general, setting of the freezing temperature correction value to substantially one half of the temperature difference between the saturated gas temperature and the saturated liquid temperature allows the heat exchanger related to heat medium 15*a* to be used most effectively, and thus is preferable.

However, when the temperature difference between the heat medium on the inlet side and outlet side of the heat exchanger related to heat medium 15*a* is small, anti-freezing control needs to be performed at a somewhat higher temperature. As such, a value obtained by multiplying a coefficient by the temperature difference between the saturated gas refrigerant temperature and the saturated liquid refrigerant temperature, or a value obtained by multiplying a weighting coefficient by the saturated gas refrigerant temperature and the saturated liquid refrigerant temperature may be set as the freezing temperature correction value. Note that the freezing temperature correction value may be obtained by the saturated gas temperature and the saturated liquid temperature computed from the circulation composition, or the correspondence between the circulation composition and the freezing temperature correction value may be stored. In the latter case, the number of computations can be reduced.

The anti-freezing control may be any method that can increase the temperature of the heat medium flowing in the heat exchanger related to heat medium 15*a* and control the heat medium to be at a higher temperature than the temperature in which the heat medium freezes and clogs the heat medium passage. For example, the drive frequency of the compressor 10 may be reduced or the compressor 10 may be stopped, or the opening degree of the expansion device 16*a* may be increased. Note that when the drive frequency of the compressor 10 is controlled on the basis of the evaporating temperature corresponding to the detection pressure of the third pressure sensor 38, it is possible to reduce the drive frequency of the compressor 10 by setting a higher target evaporating temperature.

Further, prevention of freezing of the heat exchanger related to heat medium 15*a* may be carried out by reducing the opening degree of the expansion device 16*a* to set the refrigerant passage to a nearly closed state such that no refrigerant flows into the heat exchanger related to heat medium 15*a*. Furthermore, freezing may be prevented by increasing the refrigerant temperature by making the heat exchanger related to heat medium 15*a* functioning as an evaporator function as a condenser.

Note that the freezing temperature of the heat medium, that is, the temperature in which the heat medium freezes and clogs the heat medium passage, is 0° C. when the heat medium is water and the flow velocity is zero; however, when the flow velocity is high, the freezing temperature becomes a lower temperature that is below 0° C.

[Heating Main Operation Mode]

Figure 12:
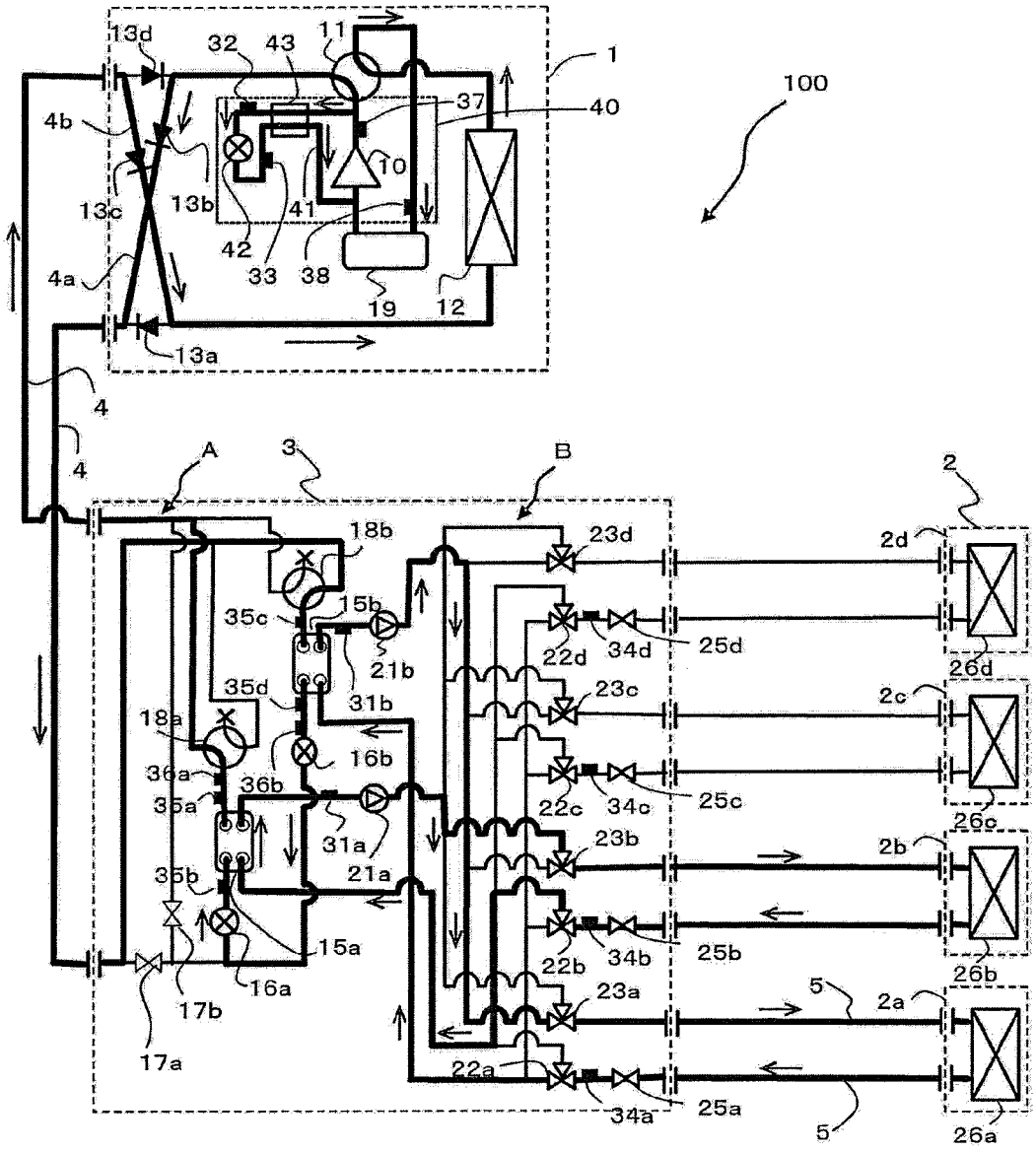
FIG. 12 is a refrigerant circuit diagram illustrating flows of refrigerants in a heating main operation mode of the air-conditioning apparatus according to the exemplary embodiment of the present invention.

FIG. 12 is a refrigerant circuit diagram illustrating the flows of the refrigerant in the heating main operation mode of the air-conditioning apparatus 100. The heating main operation mode will be described with respect to a case in which a heating load is generated in the use side heat exchanger 26*a* and a cooling load is generated in the use side heat exchanger 26*b* in FIG. 12. Furthermore, in FIG. 12, pipes indicated by thick lines correspond to pipes through which the refrigerant (the heat source side refrigerant and the heat medium) circulates. In addition, the direction of flow of the heat source side refrigerant is indicated by solid-line arrows and the direction of flow of the heat medium is indicated by broken-line arrows in FIG. 12.

In the heating main operation mode illustrated in FIG. 12, in the outdoor unit 1, the first refrigerant flow switching device 11 is switched such that the heat source side refrigerant discharged from the compressor 10 flows into the heat medium relay unit 3 without passing through the heat source side heat exchanger 12. In the heat medium relay unit 3, the pump 21*a*, and the pump 21*b* are driven, the heat medium flow control device 25*a* and the heat medium flow control device 25*b* are opened, and the heat medium flow control device 25*c* and the heat medium flow control device 25*d* are totally closed, such that the heat medium circulates between the heat exchanger related to heat medium 15*a* and the use side heat exchanger 26*b*, and between the heat exchanger related to heat medium 15*a* and the use side heat exchanger 26*b*.

First, the flow of the heat source side refrigerant in the refrigerant circuit A will be described.

A low-temperature low-pressure refrigerant is compressed by the compressor 10 and is discharged as a high-temperature high-pressure gas refrigerant. The high-temperature high-pressure gas refrigerant that has been discharged from the compressor 10 passes through the first refrigerant flow switching device 11, flows through the first connecting pipe 4*a*, passes through the check valve 13*b*, and flows out of the outdoor unit 1. The high-temperature high-pressure gas refrigerant that has flowed out of the outdoor unit 1 passes through the refrigerant pipe 4 and flows into the heat medium relay unit 3. The high-temperature high-pressure gas refrigerant that has flowed into the heat medium relay unit 3 passes through the second refrigerant flow switching device 18*b* and flows into the heat exchanger related to heat medium 15*b* functioning as a condenser.

The gas refrigerant that has flowed into the heat exchanger related to heat medium 15*b* is condensed and liquefied while transferring heat to the heat medium circulating in the heat medium circuit B, and turns into a liquid refrigerant. The liquid refrigerant flowing out of the heat exchanger related to heat medium 15*b* is expanded into a low-pressure two-phase refrigerant by the expansion device 16*b*. This low-pressure two-phase refrigerant flows through the expansion device 16*a* and into the heat exchanger related to heat medium 15*a* functioning as an evaporator. The low-pressure two-phase refrigerant that has flowed into the heat exchanger related to heat medium 15*a* absorbs heat from the heat medium circulating in the heat medium circuit B, is evaporated, and cools the heat medium. This low-pressure two-phase refrigerant flows out of the heat exchanger related to heat medium 15*a*, passes through the second refrigerant flow switching device 18*a*, flows out of the heat medium relay unit 3, and flows into the outdoor unit 1 again through the refrigerant pipe 4.

The heat source side refrigerant that has flowed into the outdoor unit 1 passes through the check valve 13*c* and flows into the heat source side heat exchanger 12 functioning as an evaporator. Then, the refrigerant that has flowed into the heat source side heat exchanger 12 removes heat from the outdoor air in the heat source side heat exchanger 12 and turns into a low-temperature low-pressure gas refrigerant. The low-temperature low-pressure gas refrigerant flowing out of the heat source side heat exchanger 12 passes through the first refrigerant flow switching device 11 and the accumulator 19 and is sucked into the compressor 10 again.

The circulation composition of the refrigerant circulating in the refrigeration cycle is measured by using the circulation composition detection means 40. Further, the controller (not shown) of the outdoor unit 1 and the controller (not shown) of the heat medium relay unit 3 are connected by wire or connected wirelessly allowing communication therebetween. The circulation composition detected in the outdoor unit 1 is transmitted through communication from the controller of the outdoor unit 1 to the controller of the heat medium relay unit 3. Note that the controller of the outdoor unit 1 and the controller of the heat medium relay unit 3 may be constituted as a single controller.

Note that the opening degree of the expansion device 16*b* is controlled such that subcooling (degree of subcooling) is constant, with the subcooling being obtained as a temperature difference between the detection temperature of the third temperature sensor 35*b* and the computed condensing temperature obtained as a mean temperature between the saturated liquid temperature and the saturated gas temperature that are computed from the circulation composition transmitted from the outdoor unit 1 through communication and from the detection pressure of the first pressure sensor 36*b*. In addition, the expansion device 16*a* is fully opened, the on-off device 17*a* is closed, and the on-off device 17*b* is closed. Alternatively, the expansion device 16*b* may be fully opened and the expansion device 16*a* may control the subcooling.

Further, by hypothesizing the detection temperature of the third temperature sensor 35*b* as a saturated liquid temperature or as a temperature at the set quality, the saturation pressure and the saturated gas temperature may be computed from the circulation composition transmitted from the outdoor unit 1 through communication and the detection temperature of the third temperature sensor 35*b*. The saturation temperature may be obtained as the mean temperature between the saturated liquid temperature and the saturated gas temperature, and this may be used to control the expansion device 16*a* or the expansion device 16*b*. In such a case, there is no need to dispose the first pressure sensor 36, and, thus, the system can be configured inexpensively.

Next, the flow of the heat medium in the heat medium circuit B will be described.

In the heating main operation mode, the heat exchanger related to heat medium 15*b* transfers heating energy of the heat source side refrigerant to the heat medium, and the pump 21*b* allows the heated heat medium to flow through the pipes 5. Furthermore, in the heating main operation mode, the heat exchanger related to heat medium 15*a* transfers cooling energy of the heat source side refrigerant to the heat medium, and the pump 21*a* allows the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*.

In the use side heat exchanger 26*b*, the heat medium removes heat from the indoor air, thus cooling the indoor space 7. In addition, in the use side heat exchanger 26*a*, the heat medium transfers heat to the indoor air, thus heating the indoor space 7. At this time, with the function of each of the heat medium flow control device 25*a* and the heat medium flow control device 25*b*, the heat medium flowing into the corresponding one of the use side heat exchanger 26*a* and the use side heat exchanger 26*b* is controlled to a flow rate that is sufficient to cover an air conditioning load required in the indoor space. The heat medium, which has passed through the use side heat exchanger 26*b* with a slight increase of temperature, passes through the heat medium flow control device 25*b* and the first heat medium flow switching device 22*b*, flows into the heat exchanger related to heat medium 15*a*, and is sucked into the pump 21*a* again. The heat medium, which has passed through the use side heat exchanger 26*a* with a slight decrease of temperature, passes through the heat medium flow control device 25*a* and the first heat medium flow switching device 22*a*, flows into the heat exchanger related to heat medium 15*b*, and is sucked into the pump 21*a* again.

During this time, with the function of the first heat medium flow switching devices 22 and the second heat medium flow switching devices 23, the heated heat medium and the cooled heat medium are introduced to the respective use side heat exchangers 26 having a heating load and a cooling load, without being mixed. Note that in the pipes 5 on both the heating side and the cooling side of each use side heat exchanger 26, the heat medium is directed to flow from the second heat medium flow switching device 23 through the heat medium flow control device 25 to the first heat medium flow switching device 22. Furthermore, each air conditioning load required in the indoor space 7 is covered by controlling the temperature difference between the temperature detected by the first temperature sensor 31*b* and that detected by the second temperature sensor 34 as a target value for the heating side, and is covered by controlling the temperature difference between the temperature detected by the second temperature sensor 34 and that detected by the first temperature sensor 31*a* as a target value for the cooling side.

Upon carrying out the heating main operation mode, since it is unnecessary to supply the heat medium to each use side heat exchanger 26 having no heat load (including thermostat off), the passage is closed by the corresponding heat medium flow control device 25 such that the heat medium does not flow into the corresponding use side heat exchanger 26. In FIG. 12, the heat medium is supplied to the use side heat exchanger 26*a* and the use side heat exchanger 26*b* because these use side heat exchangers have heat loads. The use side heat exchanger 26*c* and the use side heat exchanger 26*d* have no heat load and the corresponding heat medium flow control devices 25*c* and 25*d* are totally closed. When a heat load is generated in the use side heat exchanger 26*c* or the use side heat exchanger 26*d*, the heat medium flow control device 25*c* or the heat medium flow control device 25*d* may be opened such that the heat medium is circulated.

Incidentally, the refrigerant is a zeotropic refrigerant mixture, and the saturated gas temperature exhibits a higher temperature than the saturated liquid temperature at the same pressure. As such, the inlet side temperature of the heat exchanger related to heat medium 15*a* functioning as an evaporator, that is, the detection temperature of the third temperature sensor 35*b*, exhibits the lowest temperature.

Further, the refrigerant temperature inside the heat exchanger related to heat medium 15*a* gradually increases as the refrigerant approaches the outlet. Accordingly, it can be understood that in order to prevent freezing of the heat medium that is exchanging heat with the refrigerant in the heat exchanger related to heat medium 15*a*, control may be performed such that the detection temperature of the third temperature sensor 35*b* does not fall below the freezing temperature of the heat medium. Efficient prevention of freezing of the heat medium allows safety to be improved.

However, since heat is exchanged in the entire heat exchanger related to heat medium 15*a*, the mean temperature of the refrigerant in the heat exchanger related to heat medium 15*a* needs to be treated as the representative temperature. This mean temperature is higher than the detected temperature of the third temperature sensor 35*b*. Accordingly, if anti-freezing control is performed with the detection temperature of the third temperature sensor 35*b* at all times irrespective of the operating state, it will not be possible to control the refrigerant temperature to be lower than the detection temperature of the third temperature sensor 35*b*. As such, a countermeasure regarding the cooling capacity will be required when there is an intent to control the temperature of the heat medium at a low temperature.

In a state in which the heat exchanger related to heat medium 15*a* is acting as an evaporator, the refrigerant and the heat medium that are exchanging heat flow in parallel such that the refrigerant on the inlet side and the heat medium on the inlet side correspond to each other and the refrigerant on the outlet side and the heat medium on the outlet side correspond to each other. At this time, since the heat medium that has absorbed heat in the use side heat exchanger 26*b* flows into the heat exchanger related to heat medium 15*a* in a heated state, the heat medium on the inlet side of the heat exchanger related to heat medium 15*a* is higher in temperature than the heat medium on the outlet side thereof. The higher the temperature of the heat medium, a situation in which the heat medium is frozen and clogs the heat medium passage is less likely to occur, unless the temperature of the refrigerant exchanging heat therewith is at a further lower temperature.

That is, in the heat exchanger related to heat medium 15*a*, the refrigerant and the heat medium exchange heat while flowing in parallel to each other such that on the inlet side, the heat medium with high temperature and the refrigerant with low temperature exchange heat, and such that while approaching the outlet side, the temperature of the heat medium is reduced and the temperature of the refrigerant is increased. Accordingly, on the inlet side of the heat exchanger related to heat medium 15*a*, the refrigerant temperature is low and the heat medium temperature is high; hence, a state in which the heat medium becomes frozen and the passage becomes clogged is not easily reached.

Now, occurrence of heat medium freezing is estimated by setting a positive value larger than zero as a freezing temperature correction value and setting a value obtained by subtracting the freezing temperature correction value from the detection temperature of the third temperature sensor 35*b* as an anti-freezing temperature. If anti-freezing control is made to be performed when the refrigerant temperature drops below the anti-freezing temperature, then it will be possible to exert sufficient cooling capacity even when the target temperature of the heat medium is low. Since the representative temperature of the refrigerant in the heat exchanger related to heat medium 15*a* during heat exchange is the mean temperature between the saturated liquid temperature and the saturated gas temperature that are computed from the circulation composition, in general, setting of the freezing temperature correction value to substantially one half of the temperature difference between the saturated gas temperature and the saturated liquid temperature allows the heat exchanger related to heat medium 15*a* to be used most effectively, and thus is preferable.

However, when the temperature difference between the heat medium on the inlet side and outlet side of the heat exchanger related to heat medium 15*a* is small, anti-freezing control needs to be performed at a somewhat higher temperature. As such, a value obtained by multiplying a coefficient by the temperature difference between the saturated gas refrigerant temperature and the saturated liquid refrigerant temperature, or a value obtained by multiplying a weighting coefficient of the saturated gas refrigerant temperature and the saturated liquid refrigerant temperature may be set as the freezing temperature correction value. Note that the freezing temperature correction value may be obtained by the saturated gas temperature and the saturated liquid temperature computed from the circulation composition, or the correspondence between the circulation composition and the freezing temperature correction value may be stored. In the latter case, the number of computations can be reduced.

The anti-freezing control may be any method that can increase the temperature of the heat medium flowing in the heat exchanger related to heat medium 15*a* and control the heat medium to be at a higher temperature than the temperature in which the heat medium freezes and clogs the heat medium passage. For example, the drive frequency of the compressor 10 may be reduced or the compressor 10 may be stopped, or the opening degree of the expansion device 16*a* may be increased. Note that when the drive frequency of the compressor 10 is controlled on the basis of the evaporating temperature corresponding to the detection pressure of the third pressure sensor 38, it is possible to reduce the drive frequency of the compressor 10 by setting a higher target evaporating temperature.

Further, prevention of freezing of the heat exchanger related to heat medium 15*a* may be carried out by reducing the opening degree of the expansion device 16*a* to set the refrigerant passage to a nearly closed state such that no refrigerant flows into the heat exchanger related to heat medium 15*a*. Furthermore, freezing may be prevented by increasing the refrigerant temperature by making the heat exchanger related to heat medium 15*a* functioning as an evaporator function as a condenser.

Note that the freezing temperature of the heat medium, that is, the temperature in which the heat medium freezes and clogs the heat medium passage, is 0° C. when the heat medium is water and the flow velocity is zero; however, when the flow velocity is high, the freezing temperature becomes a lower temperature that is below 0° C.

[Refrigerant Pipe 4]

As described above, the air-conditioning apparatus 100 according to the exemplary embodiment has several operation modes. In these operation modes, the heat source side refrigerant flows through the refrigerant pipes 4 connecting the outdoor unit 1 and the heat medium relay unit 3.

[Pipe 5]

In the several operation modes carried out by the air-conditioning apparatus 100 according to the exemplary embodiment, the heat medium, such as water or antifreeze, flows through the pipes 5 connecting the heat medium relay unit 3 and the indoor units 2.

Note that an exemplary case has been described in which the first pressure sensor 36*a* is disposed in a passage between the heat exchanger related to heat medium 15*a* that functions as a cooling side in the cooling and heating mixed operation and the second refrigerant flow switching device 18*a*, and in which the first pressure sensor 36*b* is disposed in a passage between the heat exchanger related to heat medium 15*b* that functions as a heating side in the cooling and heating mixed operation and the expansion device 16*b*. By disposing each of the first pressure sensors 36 in the above position, the saturation temperature can be computed with high precision even if there is pressure loss in the heat exchanger related to heat medium 15*a* and the heat exchanger related to heat medium 15*b*.

However, since the pressure loss on the condensing side is small, the first pressure sensor 36*b* may be disposed in the passage between the heat exchanger related to heat medium 15*b* and the expansion device 16*b*. Even disposed as such, the operational precision is not degraded by much. Further, although pressure loss is relatively large in the evaporator, in a case in which a heat exchanger related to heat medium, whose amount of pressure loss can be estimated or whose pressure loss is small, is used, the first pressure sensor 36*a* may be disposed in the passage between the heat exchanger related to heat medium 15*a* and the second refrigerant flow switching device 18*a*.

Furthermore, in the air-conditioning apparatus 100, in the case in which only the heating load or cooling load is generated in the use side heat exchangers 26, the corresponding first heat medium flow switching devices 22 and the corresponding second heat medium flow switching devices 23 are controlled so as to have a medium opening degree, such that the heat medium flows into both of the heat exchanger related to heat medium 15*a* and the heat exchanger related to heat medium 15*b*. Consequently, since both of the heat exchanger related to heat medium 15*a* and the heat exchanger related to heat medium 15*b* can be used for the heating operation or the cooling operation, the heat transfer area can be increased, and accordingly the heating operation or the cooling operation can be efficiently performed.

In addition, in the case in which the heating load and the cooling load simultaneously occur in the use side heat exchangers 26, the first heat medium flow switching device 22 and the second heat medium flow switching device 23 corresponding to the use side heat exchanger 26 which performs the heating operation are switched to the passage connected to the heat exchanger related to heat medium 15*b* for heating, and the first heat medium flow switching device 22 and the second heat medium flow switching device 23 corresponding to the use side heat exchanger 26 which performs the cooling operation are switched to the passage connected to the heat exchanger related to heat medium 15*a* for cooling, so that the heating operation or cooling operation can be freely performed in each indoor unit 2.

Furthermore, each of the first heat medium flow switching devices 22 and the second heat medium flow switching devices 23 described in the exemplary embodiment may be any device that can switch passages, such as a three-way valve capable of switching between three passages or a combination of two on-off valves and the like switching between two passages. Alternatively, components such as a stepping-motor-driven mixing valve capable of changing flow rates of three passages or electronic expansion valves capable of changing flow rates of two passages used in combination may be used as each of the first heat medium flow switching devices 22 and the second heat medium flow switching devices 23. In this case, water hammer caused when a passage is suddenly opened or closed can be prevented. Furthermore, in the exemplary embodiment, while an exemplary description has been given in which the heat medium flow control devices 25 each include a two-way valve, each of the heat medium flow control devices 25 may include a control valve having three passages and the valve may be disposed with a bypass pipe that bypasses the corresponding use side heat exchanger 26.

Furthermore, as regards each of the heat medium flow control device 25, a stepping-motor-driven type that is capable of controlling the flow rate in the passage is preferably used. Alternatively, a two-way valve or a three-way valve whose one end is closed may be used. Alternatively, as regards each of the heat medium flow control device 25, a component, such as an on-off valve, which is capable of opening or closing a two-way passage, may be used while ON/OFF operations are repeated to control an average flow rate.

Furthermore, while each second refrigerant flow switching device 18 has been described as a four-way valve, the device is not limited to this type. The device may be configured such that the refrigerant flows in the same manner using a plurality of two-way flow switching valves or three-way flow switching valves.

While the air-conditioning apparatus 100 according to the exemplary embodiment has been described with respect to the case in which the apparatus can perform the cooling and heating mixed operation, the apparatus is not limited to the case. The same advantages can be obtained even in an apparatus that is configured by a single heat exchanger related to heat medium 15 and a single expansion device 16 having a plurality of use side heat exchangers 26 and heat medium flow control devices 25 connected in parallel thereto, and even in an apparatus that is only capable of carrying out a cooling operation or a heating operation.

In addition, it is needless to say that the same holds true for the case in which only a single use side heat exchanger 26 and a single heat medium flow control device 25 are connected. Moreover, it is needless to say that no problem will arise even if the heat exchanger related to heat medium 15 and the expansion device 16 acting in the same manner are arranged as a plurality of units. Furthermore, while the case has been described in which the heat medium flow control devices 25 are equipped in the heat medium relay unit 3, the arrangement is not limited to this case. Each heat medium flow control device 25 may be disposed in the indoor unit 2. The heat medium relay unit 3 and the indoor unit 2 may be constituted in different housings.

As regards the heat medium, for example, brine (antifreeze), water, a mixed solution of brine and water, or a mixed solution of water and an additive with high anticorrosive effect can be used. In the air-conditioning apparatus 100, therefore, even if the heat medium leaks into the indoor space 7 through the indoor unit 2, because the heat medium used is very safe, contribution to improvement of safety can be made.

While the exemplary embodiment has been described with respect to the case in which the air-conditioning apparatus 100 includes the accumulator 19, the accumulator 19 may be omitted. Typically, a heat source side heat exchanger 12 and a use side heat exchanger 26 are provided with an air-sending device in which a current of air often facilitates condensation or evaporation. The structure is not limited to this case. For example, a heat exchanger, such as a panel heater, using radiation can be used as the use side heat exchanger 26 and a water-cooled heat exchanger, which transfers heat using water or antifreeze, can be used as the heat source side heat exchanger 12. In other words, any heat exchanger capable of transferring heat or removing heat may be used regardless of the type as each of the heat source side heat exchanger 12 and the use side heat exchanger 26.

The exemplary embodiment has been described in which the number of heat exchangers related to the use side heat exchanger 26 is four. As a matter of course, the number is not limited in particular. Furthermore, description has been made illustrating a case in which there are two heat exchangers related to heat medium 15, namely, the heat exchanger related to heat medium 15*a* and the heat exchanger related to heat medium 15*b*. As a matter of course, the arrangement is not limited to this case, and any number of heat exchangers related to heat medium may be disposed as long as cooling and/or heating of the heat medium can be carried out. Furthermore, each of the number of pumps 21*a* and that of pumps 21*b* is not limited to one. A plurality of pumps having a small capacity may be connected in parallel.

As above, the air-conditioning apparatus 100 according to the exemplary embodiment can not only improve safety by not circulating the heat source side refrigerant to the indoor units 2 or near the indoor units 2, but also can effectively prevent freezing of the heat medium and execute a highly safe operation such that energy efficiency is reliably improved. Further, the pipes 5 can be shortened in the air-conditioning apparatus 100, thus energy saving can be achieved. Furthermore, the air-conditioning apparatus 100 can reduce the connecting pipes (the refrigerant pipes 4 and the pipes 5) between the outdoor unit 1 and the heat medium relay unit 3, and between the heat medium relay unit 3 and the indoor units 2, thus increase ease of construction.

The invention claimed is:

1. An air-conditioning apparatus, comprising:

a refrigerant circuit that connects a compressor, a first refrigerant flow switching device, a heat source side heat exchanger, a plurality of first expansion devices, and refrigerant side passages of a plurality of heat exchangers related to a heat medium by refrigerant pipes, the refrigerant circuit circulating a heat source side refrigerant;

a heat medium circuit that connects a pump, a use side heat exchanger, and heat medium side passages of the plurality of heat exchangers related to heat medium by heat medium pipes, the heat medium circuit circulating the heat medium; and the heat source side refrigerant and the heat medium exchanging heat in each of the heat exchangers related to heat medium, wherein a zeotropic refrigerant mixture, in which a saturated liquid refrigerant temperature is lower than a saturated gas refrigerant temperature under a same pressure condition, is used as the heat source side refrigerant, when at least one of the heat exchangers related to heat medium is functioning as an evaporator, an anti-freezing control that prevents the heat medium from freezing is executed if a temperature obtained by subtracting a freezing temperature correction value set as a positive value corresponding to a temperature difference between the saturated gas refrigerant temperature and the saturated liquid refrigerant temperature of the heat source side refrigerant from an evaporating temperature of the refrigerant in an inlet side of the at least one of the heat exchangers related to heat medium drops below an anti-freezing temperature, wherein the freezing temperature correction value is obtained by multiplying a coefficient by the temperature difference between the saturated gas refrigerant temperature and the saturated liquid refrigerant temperature, or is obtained by multiplying a weighting coefficient by the saturated gas refrigerant temperature and the saturated liquid refrigerant temperature, and wherein the coefficient is other than 1.

2. The air-conditioning apparatus of claim 1, wherein the refrigerant circuit is formed by connecting the compressor, the first refrigerant flow switching device, the heat source side heat exchanger, the plurality of first expansion devices, the refrigerant side passages of the plurality of heat exchangers related to heat medium, and a plurality of second refrigerant flow switching devices with the refrigerant pipes, and the heat medium circuit is formed by connecting the pump, the use side heat exchanger, the heat medium side passages of the plurality of heat exchangers related to heat medium, and a heat medium flow switching device with the heat medium pipes, the heat medium flow switching device selectively allowing either one of a cooled heat medium or a heated heat medium to be passed to the use side heat exchanger.

3. The air-conditioning apparatus of claim 1, further comprising a high-low pressure bypass pipe that connects a discharge side and a suction side of the compressor, a second expansion device disposed in the high-low pressure bypass pipe, and a refrigerant-to-refrigerant heat exchanger that mutually exchanges heat between the high-low pressure bypass pipe before and after the second expansion device, wherein a circulation composition that is a composition ratio of the heat source side refrigerant circulating in the refrigerant circuit is computed by using a low-pressure side pressure on a suction side of the compressor, a high-pressure side temperature on an inlet side of the second expansion device, and a low-pressure side temperature on an outlet side of the second expansion device, and the freezing temperature correction value is obtained on the basis of the saturated liquid refrigerant temperature and the saturated gas refrigerant temperature of the heat source side refrigerant after the saturated liquid refrigerant temperature and the saturated gas refrigerant temperature of the heat source side refrigerant are computed from the circulation composition, or the freezing temperature correction value is obtained and is stored after being made to correspond with the circulation composition.

4. The air-conditioning apparatus of claim 3, wherein the freezing temperature correction value is substantially one half of the temperature difference between the saturated gas refrigerant temperature and the saturated liquid refrigerant temperature.

5. The air-conditioning apparatus of claim 3, wherein a frequency of the compressor is controlled on the basis of an evaporating temperature, which corresponds to a low-pressure side pressure, computed by a low-pressure side pressure on the suction side of the compressor and the circulation composition.

6. The air-conditioning apparatus of claim 1, wherein the anti-freezing control is executed such that the temperature of the heat source side refrigerant flowing in the plurality of heat exchangers related to heat medium is controlled to be a temperature that is higher than the temperature in which the heat medium in the heat exchanger related to heat medium freezes and clogs a passage.

7. The air-conditioning apparatus of claim 6, wherein the anti-freezing control is executed such that the frequency of the compressor is reduced.

8. The air-conditioning apparatus of claim 6, wherein the anti-freezing control is executed such that the compressor is stopped.

9. The air-conditioning apparatus of claim 6, wherein the anti-freezing control is executed such that opening degrees of the plurality of first expansion devices are increased.

10. The air-conditioning apparatus of claim 6, wherein the anti-freezing control is executed such that an opening degree of the first expansion device corresponding to the at least one of the heat exchangers related to heat medium that is functioning as an evaporator is set to a substantially closed state to prevent the heat source side refrigerant from flowing into the heat exchanger related to heat medium.

11. The air-conditioning apparatus of claim 6, wherein the anti-freezing control is executed such that either or all of the plurality of heat exchangers related to heat medium functioning as an evaporator is made to function as a condenser.

12. The air-conditioning apparatus of claim 1, further comprising an outdoor unit that houses the compressor, the first refrigerant flow switching device, and the heat source side heat exchanger, a heat medium relay unit that houses at least the heat exchangers related to heat medium, the first expansion devices, and the pump, an indoor unit that houses the use side heat exchanger, the outdoor unit, the heat medium relay unit, and the indoor unit being formed as respective separate housings that can be disposed at separate positions, and a controller that corresponds to each of the outdoor unit, the heat medium relay unit, and the indoor unit, wherein the anti-freezing control is executed such that a correction value of an evaporating temperature corresponding to a low-pressure side pressure is communicated from a controller corresponding to the outdoor unit to a controller corresponding to the heat medium relay unit to raise the evaporating temperature corresponding to the low-pressure side pressure in the heat medium relay unit.

13. The air-conditioning apparatus of claim 1, comprising:

a heating only operation mode in which all of the plurality of heat exchangers related to heat medium function as condensers, a cooling only operation mode in which all of the plurality of heat exchangers related to heat medium function as evaporators, and a cooling and heating mixed operation mode in which part of the plurality of heat exchangers related to heat medium functions as a condenser and other part of the remaining plurality of heat exchangers related to heat medium functions as an evaporator.

14. The air-conditioning apparatus of claim 1, wherein the refrigerant and the heat medium flow in parallel to each other in the at least one of the heat exchangers related to heat medium that is functioning as an evaporator.

15. The air-conditioning apparatus of claim 1, wherein a refrigerant mixture of at least a refrigerant expressed by a chemical formula $C_3H_2F_4$ having a single double bond in a molecular structure and a refrigerant expressed by a chemical formula $CH_2F_2$ is used as the heat source side refrigerant.

* * * * *